US010593292B2

(12) United States Patent
Ninan et al.

(10) Patent No.: US 10,593,292 B2
(45) Date of Patent: Mar. 17, 2020

(54) DYNAMIC POWER MANAGEMENT FOR AN HDR DISPLAY

(71) Applicant: Dolby Laboratories Licensing Corporation, San Francisco, CA (US)

(72) Inventors: Ajit Ninan, San Jose, CA (US); Chun Chi Wan, Campbell, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/559,798

(22) PCT Filed: Mar. 22, 2016

(86) PCT No.: PCT/US2016/023630
§ 371 (c)(1),
(2) Date: Sep. 19, 2017

(87) PCT Pub. No.: WO2016/154225
PCT Pub. Date: Sep. 29, 2016

(65) Prior Publication Data

US 2018/0068637 A1 Mar. 8, 2018

Related U.S. Application Data

(60) Provisional application No. 62/137,135, filed on Mar. 23, 2015.

(51) Int. Cl.
*G09G 5/10* (2006.01)

(52) U.S. Cl.
CPC ..... *G09G 5/10* (2013.01); *G09G 2320/0626* (2013.01); *G09G 2330/021* (2013.01)

(58) Field of Classification Search
CPC .. G06G 5/10; G06G 3/3426; G06G 2320/066; G06G 2320/0626
See application file for complete search history.

(56) References Cited

U.S. PATENT DOCUMENTS 8,792,016 B2 * 7/2014 Guan ..... G06T 5/008 348/223.1
8,830,158 B2 9/2014 Park
2003/0229899 A1 * 12/2003 Thompson ..... H04N 7/17318 725/87
2005/0052665 A1 * 3/2005 Moroney ..... G06T 5/008 358/1.9

(Continued)

FOREIGN PATENT DOCUMENTS

WO 2008/142602 11/2008
WO 2011/075381 6/2011

(Continued)

*Primary Examiner* — Alexander Eisen
*Assistant Examiner* — Kebede T Teshome

(57) ABSTRACT

An input media signal encoded with a portion of image data to be rendered with a target display device is received. It is determined, based on the portion of image data, whether a first power profile is to be applied to rendering the portion of image data with the target display device. In response to determining, based on the portion of image data, that the first power profile is not to be applied to rendering the portion of image data with the target display device, a second power profile is applied to rendering the portion of image data with the target display device.

15 Claims, 12 Drawing Sheets

(56) References Cited

U.S. PATENT DOCUMENTS

| | | | | |
|---|---|---|---|---|
| 2006/0119613 | A1 | 6/2006 | Kerofsky | |
| 2008/0170030 | A1 | 7/2008 | Oshige | |
| 2010/0156955 | A1* | 6/2010 | Kimura | G09G 3/3426 345/690 |
| 2010/0220937 | A1* | 9/2010 | Furbeck | H04N 19/147 382/246 |
| 2011/0267379 | A1 | 11/2011 | Kurabayashi | |
| 2014/0132650 | A1 | 5/2014 | Shin | |
| 2016/0252759 | A1* | 9/2016 | Woodgate | G02F 1/13338 348/54 |

FOREIGN PATENT DOCUMENTS

| | | |
|---|---|---|
| WO | 2012/114989 | 8/2012 |
| WO | 2014/002712 | 1/2014 |

* cited by examiner

DYNAMIC POWER MANAGEMENT FOR AN HDR DISPLAY

CROSS-REFERENCE TO RELATED APPLICATION

This application is a U.S. 371 national phase application claiming priority from PCT International Application No. PCT/US2016/023630 filed Mar. 22, 2016 and claims the benefit of the priority filing date of U.S. application No. 62/137,135 filed Mar. 23, 2015.

TECHNOLOGY

The present invention relates generally to display techniques, and in particular, to dynamic power management for an HDR display.

BACKGROUND

A display device may comprise light sources that generate illumination on pixels implemented as light valves with light modulation layers of the display device. Any such pixel implemented with the light modulation layers may be set to the maximum light transmittance to generate the maximum luminance value for that pixel. Any such pixel also may be set to the minimum light transmittance to generate the minimum luminance value for that pixel.

High dynamic range images may comprise a wide range of luminance values from the minimum luminance value being a tiny fraction of a nit to the maximum luminance value being possibly over 10,000 nits or more. To render a high dynamic range image, a display device would need to support the wide range of luminance values in each and every pixel of the display device. However, to engineer a display device with high luminance range in each and every pixel of the display device not only is a technically difficult endeavor but also typically requires a relatively high electric power rating sufficient to generate the maximum luminance value in each pixel when the pixel is set to maximum light transmittance. This high power rating may preclude the display device from becoming an ENERGY STAR® certified product and from gaining economic and reputational benefits attendant to such certification.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section. Similarly, issues identified with respect to one or more approaches should not assume to have been recognized in any prior art on the basis of this section, unless otherwise indicated.

BRIEF DESCRIPTION OF DRAWINGS

The present invention is illustrated by way of example, and not by way of limitation, in the figures of the accompanying drawings and in which like reference numerals refer to similar elements and in which.

DESCRIPTION OF EXAMPLE POSSIBLE EMBODIMENTS

Figure 1:
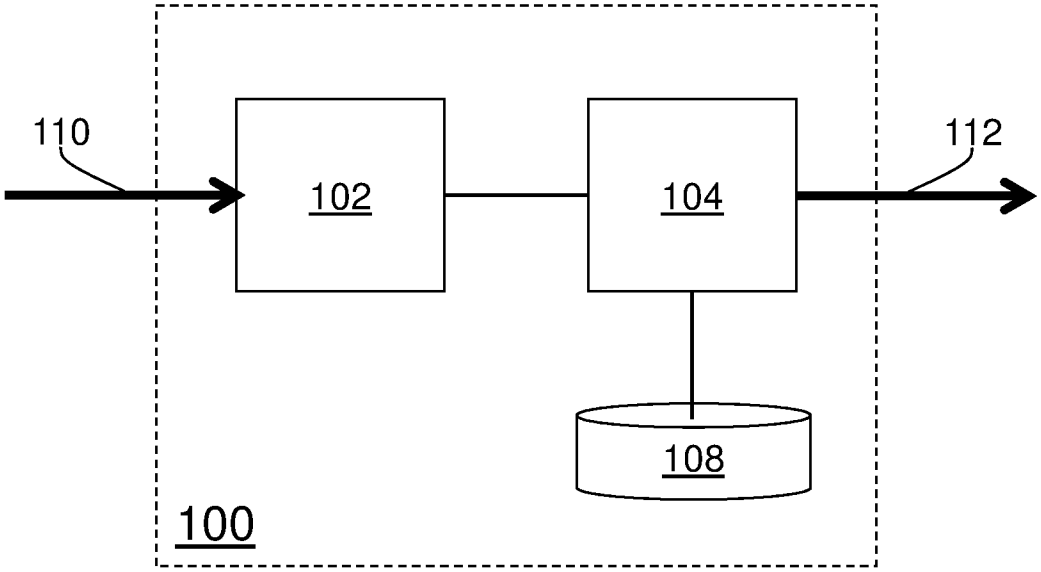
FIG. 1 illustrates an example power management module.

Example possible embodiments, which relate to dynamic power management for an HDR display, are described herein. In the following description, for the purposes of explanation, numerous specific details are set forth in order to provide a thorough understanding of the present invention. It will be apparent, however, that the present invention may be practiced without these specific details. In other instances, well-known structures and devices are not described in exhaustive detail, in order to avoid unnecessarily occluding, obscuring, or obfuscating the present invention.

Example embodiments are described herein according to the following outline:

1. GENERAL OVERVIEW
2. STRUCTURE OVERVIEW
3. EXAMPLE SYSTEM CONFIGURATIONS
4. CONSTANT LIGHT POWER PROFILES
5. GLOBAL DIMMING POWER PROFILES
6. LOCAL DIMMING POWER PROFILES
7. HIGHLIGHT LOCAL DIMMING POWER PROFILES
8. ADAPTABLE FULL SCREEN MAXIMUM LUMINANCE VALUE
9. EXAMPLE PROCESS FLOW
10. IMPLEMENTATION MECHANISMS—HARDWARE OVERVIEW
11. EQUIVALENTS, EXTENSIONS, ALTERNATIVES AND MISCELLANEOUS

1. General Overview

This overview presents a basic description of some aspects of a possible embodiment of the present invention. It should be noted that this overview is not an extensive or exhaustive summary of aspects of the possible embodiment. Moreover, it should be noted that this overview is not intended to be understood as identifying any particularly significant aspects or elements of the possible embodiment, nor as delineating any scope of the possible embodiment in particular, nor the invention in general. This overview merely presents some concepts that relate to the example possible embodiment in a condensed and simplified format, and should be understood as merely a conceptual prelude to a more detailed description of example possible embodiments that follows below.

Techniques as described herein can be used by a high dynamic range (HDR) display device to render images of a high dynamic range (e.g., 2,000 nits, 10,000 nits, 20,000 nits or more, etc.) that is multiple times (e.g., five times, ten times, over ten times, etc.) higher than a relatively narrow dynamic range (e.g., 300 nits, 500 nits, 1,000 nits, etc.) supported by a standard dynamic range (SDR) display device, and in the meantime to incur power consumption that is comparable to or fractionally larger than that of the SDR display device.

A display device comprising techniques as described herein can be configured to apply a different power profile such as a global dimming power profile, a local dimming power profile, a highlight local dimming power profile, etc., in image rendering operations other than a constant light power profile. A power profile may refer to a set of one or more specific power management strategies/techniques used to allocate constrained power consumption budgets/limits for light illumination amongst all pixels of a display in image rendering operations. In some embodiments, a power profile as described herein may be defined on a pixel basis. In some other embodiments, a power profile as described herein may be defined on a sub-pixel basis. A power budget allocated to illuminate pixels may be a combination of sub-pixel level power budges allocated to illuminate sub-pixels of different types in the pixels. Additionally, optionally, or alternatively, in some embodiments, a pixel as referred to herein may be construed to be a sub-pixel; some or all of techniques as described herein can be applied on a sub-pixels level in addition to, or in place of, a pixel level.

The constant light power profile refers to a power profile under which a display device illuminates each and every pixel of the display device across all images with the same constant light intensity.

The global dimming power profile refers to a power profile under which a display device illuminates each and every pixel of the display device for each image with the same constant light intensity but may vary the light intensity from image to image depending on the maximum luminance value of each image or each image group (e.g., in a scene, etc.).

The local dimming power profile refers to a power profile under which a display device illuminates each and every pixel of the display device for each spatial region of multiple spatial regions in an image with the same constant light intensity but may vary the light intensity from spatial region to spatial region, from image to image, from image group to image group, etc., depending on spatial regions used to partition the image, the maximum luminance value in each spatial region of the multiple spatial regions in each image, in each image group, etc.

The highlight local dimming power profile refers to a power profile under which a display device illuminates each and every pixel of the display device for each spatial region in highlighted areas of an image with a constant light intensity under a highlight peak luminance value and illuminate each and every pixel of the display device for each spatial region in non-highlighted areas of the image with a constant light intensity under a full screen maximum luminance value, but may vary the light intensities in the highlighted areas and non-highlighted areas from spatial region to spatial region, from image to image, from image group to image group, etc., depending on spatial regions used to partition the image, the maximum luminance value in each spatial region of the multiple spatial regions in each image, in each image group, etc.

In some embodiments, the maximum luminance value for an image that can be rendered under a constant light power profile, a global dimming power profile, a local dimming power profile, etc., is limited by an overall power consumption available to the light sources in a display device.

For example, a display device that is limited to an overall power consumption of 100 watts available to the light sources in the display device may be able to render the maximum brightness level corresponding to a full screen maximum luminance value such as 500 nits. To render an image up to a higher full screen maximum luminance value such as 2,000 nits, such a display device would need to scale the overall power consumption to 400 watts. In other words, under a constant light power profile, a global dimming power profile, a local dimming power profile, etc., the increase of power consumption in a display device would be directly proportional to the increase of the full screen maximum luminance value of the display device.

In some embodiments, under a highlight local dimming power profile, a display device is configured to illuminate pixels in non-highlighted areas of an image up to a full screen maximum luminance value (e.g., 500 nits, etc.), and to illuminate pixels in highlighted areas of the image up to a highlight peak luminance value (e.g., 2,000 nits, etc.) higher than the full screen maximum luminance value, provided that the light sources in the display device support the highlight peak luminance value and that the overall power consumption (e.g., 50 watts, 80 watts, 100 watts, 112 watts, etc.) for illuminating pixels does not exceed a highlight peak power limit (e.g., 115 watts, etc.) specific to the display device. In some embodiments, the highlight peak power limit need not be multiple times of the overall power consumption (e.g., 100 watts, etc.) for illuminating pixels to the full screen maximum luminance value but rather only a fraction higher than, or even equal to, the overall power consumption (e.g., 100 watts, etc.) for illuminating pixels to the full screen maximum luminance value (e.g., 500 nits, etc.).

In some embodiments, the highlight peak power limit is the same as the overall power consumption (e.g., 100 watts, etc.) for illuminating pixels to the full screen maximum luminance value (e.g., 500 nits, etc.). In these embodiments, the extra power consumption may be derived from dynamically clipping or adapting the full screen maximum luminance value for pixels in the non-highlighted areas to a lower value for spatial regions in non-highlighted areas of the image. Power savings from the clipping the full screen maximum luminance values for pixels in the non-highlighted areas can be used to illuminate the pixels in the highlighted areas.

Additionally, optionally, or alternatively, the highlight peak power limit may be the same as the overall power consumption (e.g., 100 watts, etc.) for illuminating pixels to the full screen maximum luminance value (e.g., 500 nits, etc.), for example it can amount to a fraction such as 10%, 12%, 15%, etc., higher than the overall power consumption limit. In these embodiments, the difference between the highlight peak power limit and the overall power consumption (e.g., 100 watts, etc.) for illuminating pixels to the full screen maximum luminance value can be used to illuminate the pixels in the highlighted areas.

In some embodiments, when the size of the highlighted areas in the image is no larger than a highlight area size limit, all luminance values up to a highlight peak luminance limit in the image including the highlighted areas can be rendered by a display device that implements power management techniques as described herein.

Additionally, optionally, or alternatively, when the size of the highlighted areas in the image is above the highlight area size limit, depending on image data, not all luminance values in the image up to the highlight peak luminance limit can be rendered by a target display device that implements power management techniques as described herein. In these embodiments, the highlighted area may be illuminated under a constraint that the power consumption for illuminating the highlighted area above the full screen maximum luminance value and illuminating the non-highlighted area no more than the full screen maximum luminance value is no more than the highlight peak power limit.

In some embodiments, an extra power consumption limit for illuminating the highlighted area above the full screen maximum luminance value may be estimated or represented as the product of a first quantity multiplied with a second quantity. The first quantity may be the difference between the full screen maximum luminance value and a group luminance value (or a statistical luminance value such as an average luminance value) computed based on a distribution of maximum luminance values in spatial regions in the highlighted areas of the image. The second quantity may be the size of the highlighted area. The extra power consumption limit may be related to or represented as the product of a third quantity and a fourth quantity. The third quantity may be the difference between the full screen maximum luminance value and a highlight peak luminance limit for maximum luminance values in spatial regions in the highlighted areas of the image. The fourth quantity may be the highlight area size limit.

In some embodiments, one or both of the highlight peak luminance limit or the highlight area size limit may be preconfigured, configured by a user, dynamically configured, configured at the factory, configured as a design limit, etc., specifically for a target display device as described herein. Different target display devices may be configured with different sets of one or more power profiles, different highlight peak luminance limits, different highlight area size limits, etc.

Under techniques as described herein, images can be rendered up to the upper limit or the highlight peak luminance limit supported by a display device, while the increase of power consumption in the display device can be capped at the same power consumption level as or only a fraction higher than that of another display device that can only render up to luminance values much (e.g., several times, ten times or more, etc.) lower than the upper limit of the specific dynamic range. Hence the techniques as described herein can be used by display manufacturers to create display devices that have very high dynamic range for highlighted areas as well as keep power consumptions of these display devices sufficiently low to qualify for ENERGY STAR certification.

In some embodiments, a method comprises providing a display system as described herein. In some possible embodiments, mechanisms as described herein form a part of a system, including but not limited to a factory manufacturing system, a placement machine, a display system, an outdoor image display, a handheld device, game machine, television, laptop computer, netbook computer, cellular radiotelephone, electronic book reader, point of sale terminal, desktop computer, computer workstation, computer kiosk, PDA and various other kinds of terminals and display units.

Various modifications to the preferred embodiments and the generic principles and features described herein will be readily apparent to those skilled in the art. Thus, the disclosure is not intended to be limited to the embodiments shown, but is to be accorded the widest scope consistent with the principles and features described herein.

2. Structure Overview

FIG. 1 illustrates an example power management module 100 comprising a decoding unit 102, a power profile controller 104, a power profile data repository 108, etc. The power management module (100) may be incorporated in one or more of upstream media devices, downstream media devices, media content servers, set-top boxes, display devices, media stream servers, multimedia devices, media transcoding systems, etc.

In some embodiments, the decoding unit (102) may comprise software, hardware, a combination of software and hardware, etc., configured to receive an input media signal 110, decode or decompress the input media signal (110) into input media content such as input image data, input audio sample data, etc. The input media signal (110) may be, but is not limited to only, any of: video signals, multi-layer video signals, coded bitstreams, multimedia files, etc.

The input media signal (110) may be encoded with the input media content in a standard-based format, a proprietary format, an extension format based at least in part on a standard-based format, etc. Additionally and/or optionally, the input media signal (110) may comprise metadata. In some embodiments, the metadata contains parameters, data fields, etc., related to but separate from the input media content encoded therein. Example parameters in the metadata may include, but are not necessarily limited to only, any of: power management parameters, media program parameters, scene parameters, frame parameters, luminance parameters, etc.

The input media content may initially be in any of a plurality of formats (e.g., standard based, proprietary, extension of a standard based or proprietary format, etc.) and derived from any of a variety of media content sources such as image acquisition devices, cameras, media content servers, tangible media, studio systems, content databases, etc. Examples of input media content may include, but are not limited to only, any of: raw images, digital photos, video images, 3D images, non-3D images, computer-generated graphics, scene-referred images, device-referred images, images with various dynamic ranges, etc.

The input media content may comprise image data coded in any of a variety of color spaces such as one of RGB color spaces, YUV color spaces, YDzDx color spaces, etc. In an example, each pixel value in an image represented in the input media content comprises component pixel values (e.g., sub-pixels, etc.) for some or all channels defined in a color space such as red, green and blue color channels in a RGB color space, luma and chroma channels in a YCbCr color space, etc.

In some embodiments, the input image data in the input media content decoded from the input media signal (110) may comprise reference code values in a code space comprising a wide range of luminance values such as maximum luminance values (or maximum brightness levels) up to 5,000 nits, 12,000 nits, 20,000 nits or more. These reference code values can be perceptually-based or non-perceptually based.

Perceptually-based reference code values may represent quanta (e.g., just noticeable differences or JNDs, etc.) of human perception in a human visual model. In some embodiments, a perceptually-based reference code value is not to be directly read as a physical luminance value, a power value (e.g., gamma compressed or expanded values, etc.) of a physical luminance value, etc. In some embodiments, a perceptually-based reference code value may be converted by a recipient unit (e.g., a target display device, a set-top box, a multimedia device, a power management module such as 100, etc.) to a physical luminance value, a digitized voltage value, etc., based on a lookup table (LUT), a mapping curve, mapping piece-wise linear line segments, etc.

The input media signal (110) may be received by the power management module (100) or the decoding unit (102) therein through a data connection. As used herein, a data connection may refer to any of: network connections, digital data interfaces, local data connections, data interfaces with tangible storage media, data connections involving intermediate devices (e.g., transcoders, gateways, routers, switches, etc.), etc.

In some embodiments, the power profile controller (104) comprises software, hardware, a combination of software and hardware, etc., configured to receive, from the decoding unit (102), the input media content decoded from the input media signal (110); determine one or more content-dependent distributions of luminance values in one or more portions of the input media content (or the input image data therein); select one or more power profiles (e.g., specifically set up for a target display device, as retrieved from the power profile data repository 108, etc.) respectively corresponding to the one or more content-dependent distributions of luminance values in one or more portions of the input media content; apply the one or more power profiles respectively to the one or more portions of the input media content to generate one or more portions of output media content 112; provide the output media content (112) to one or more downstream recipient modules (e.g., the target display device, an image rendering module in the target display device, a set-top box local to the target display device, etc.); etc.

In some embodiments, at least one of the one or more power profiles may be adaptive, dynamic, and dependent on image data for which power management operations as described herein are performed during rendering images represented in the image data. For example, a target display device operating in an adaptive, dynamic, and image data dependent power profile may dynamically vary or adapt maximum luminance values, minimum luminance values, etc., among different images, among different image groups, among different portions of an image, etc., in the image data.

In some embodiments, the output media content (112), as generated by the power profile controller (104) after applying the selected power profiles to the input media content decoded from the input media signal (110), constitutes power managed media content that maximally preserves the luminance dynamic range (e.g., up to a highlight peak luminance limit, etc.) represented in the input media content of the input media signal (110) while effectively limits the power consumption, or keep the power consumption within an allowable limit, of the target display device for which the power profiles are set up. In some embodiments, the power managed media content comprises adapted code values (e.g., luminance-related values, color component values, RGB values, YUV values, etc.) that have been adapted for the target display device based on the power profiles specifically set up for the target display device.

3. Example System Configurations

Techniques as described herein support power management in a variety of system configurations.

Figure 2A:
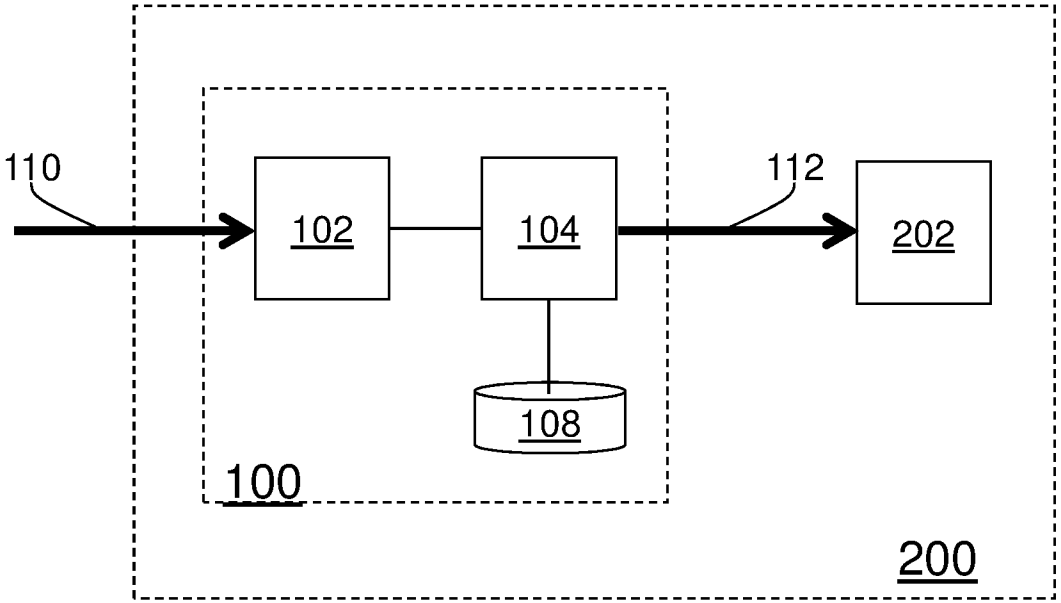
FIG. 2A through FIG. 2C illustrate example system configurations with a power management module.

FIG. 2A illustrates an example system configuration in which a target display device 200 incorporates a power management module (e.g., 100 of FIG. 1).

A display device (or a target display device) as described herein may refer to a backlit display, a side-lit display, a projection display, a direct light emitting diode (LED) display, an organic light emitting diode (OLED) display, etc. The display device may comprise pixels such as one or more of liquid crystal display unit structures, pixel or sub-pixel level LEDs, pixel or sub-pixel level OLEDs, etc., that can be used to modulate light transmission and/or light reflection for the purpose of rendering images based on image data. The display device may be configured to receive an input media signal such as a SDR video signal, an HDR video signal, etc., and perform power management operations as described herein based at least in part on image data decoded from the input media signal.

In some embodiments, the power profile controller (104) in the power management module (100) as incorporated by the target display device (200) of FIG. 2A may distribute the output media content (112) to a display management module 202 in the target display device (200). In some embodiments, the display management module (202) can be implemented as a separate module from the power management module (100). In some other embodiments, the display management module (202) can be integrated with the power management module (100) as a single unified (e.g., display management, etc.) module.

In some embodiments, the display management module (202) may comprise software, hardware, a combination of software and hardware, etc., configured to maintain display management parameters for the target display device (200). In some embodiments, the display management parameters may at least in part specify a display-specific luminance level hierarchy associated with the target display device (200). The display management parameters defining the display-specific luminance level hierarchy may include maximum (max) and minimum (min) gray levels supported by the target display device (200). The display management parameters may also include color primaries (primaries) supported by the target display device (200), display size (size), optical reflectivity of the target display device's image rendering surface, ambient light level, etc.

Some of the display management parameters maintained by the display management module (202) may be preconfigured with fixed values. Some of the display management parameters may be measured in real-time or near real-time by the target display device (200). Some of the display management parameters may be configurable by a user of the target display device (200). Some of the display management parameters may be preconfigured with default values and may be overridden by measurement or by a user.

The display management module (202) may be configured to map the adapted code values in the output media content (112) to device-specific code values (e.g., specific to the target display device 200, etc.) based on some or all of the display management parameters, convert the device-specific code values to display-specific digital driving levels such as digitized voltage levels, etc., to render images represented in the output media content (112), etc.

In some embodiments, the target display device (200) may be preconfigured with power profiles for the target display device (200), for example, in the power profile data repository (108) of the power management module (100) as incorporated in the target display device (200) of FIG. 2A.

Additionally, optionally or alternatively, preprocessing and post processing steps (which may include, but are not limited only to, color space conversion, down sampling, upsampling, tone mapping, color grading, decompression, compression, etc.) may be performed by the target display device (200).

Figure 2B:
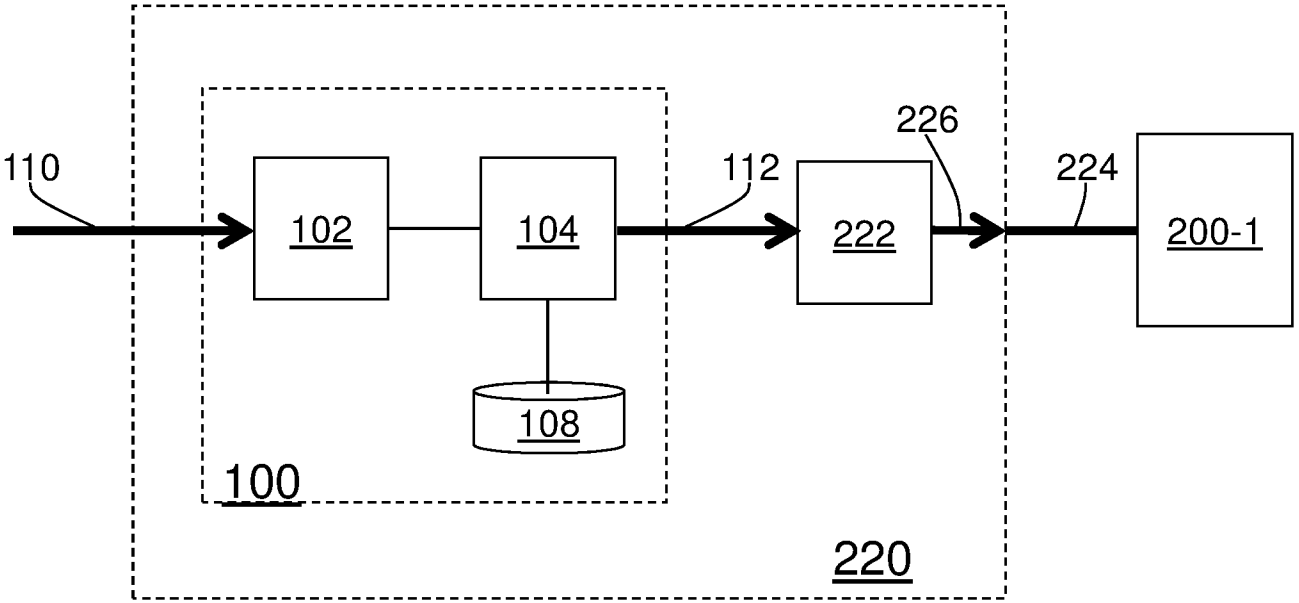

FIG. 2B illustrates an example system configuration in which a set-top box 220 incorporates a power management module (e.g., 100 of FIG. 1).

In some embodiments, the power profile controller (104) in the power management module (100) as incorporated by the set-top box (220) may distribute the output media content (112) to an encoding module 222 in the set-top box (220). In some embodiments, the encoding module (222) can be implemented as a separate module from the power management module (100). In some other embodiments, the encoding module (222) can be integrated as with the power management module (100) as a single unified (e.g., power profile management, etc.) module.

In some embodiments, the encoding module (222) may comprise software, hardware, a combination of software and hardware, etc., configured to encode adapted code values in the output media content (112), which have been adapted for a target display device 200-1 based on power profiles specifically set up for the target display device (200-1), into an output media signal 226, transmit the output media signal (226) over a data connection 224 to a target display device 200-1 for rendering images represented in the output media content (112), etc. The set-top box (220) may, but is not limited to, be local to the target display device (200-1).

In some embodiments, a display management module may be incorporated by at least one of the set-top box (220) or the target display device (200-1). The display management module may be configured to maintain display management parameters for the target display device (200-1), map the adapted code values in the output media content (112) to device-specific code values (e.g., specific to the target display device 200-1, etc.) based on some or all of the display management parameters, etc. The target display device (200-1) may be configured to convert the device-specific code values to display-specific digital driving levels such as digitized voltage levels, etc., to render images represented in the output media content (112), etc.

In some embodiments, the set-top box (220) may be preconfigured with power profiles for one or more target display devices (e.g., 200 of FIG. 2A, 200-1 of FIG. 2B, etc.), for example, in the power profile data repository (108) of the power management module (100) as incorporated in the set-top box (220). In some embodiments, the set-top box (220) may receive the power profiles for the target display device (200-1) over the data connection (224), for example, from the target display device (200-1). In some embodiments, at least one of the power profiles for the target display device (200-1) may be obtained by the set-top box (220) in real-time or near real-time, for example, from the target display device (200-1) in a feedback data flow. In some embodiments, a power profile as described herein may be at least in part configurable by a user of one or more of a target display device (e.g., 200 of FIG. 2A, 200-1 of FIG. 2B), a set-top box (220), etc.

Additionally, optionally or alternatively, preprocessing and post processing steps (which may include, but are not limited only to, color space conversion, down sampling, upsampling, tone mapping, color grading, decompression, compression, etc.) may be performed by one or both of the set-top box (220) and the target display device (200-1).

Figure 2C:
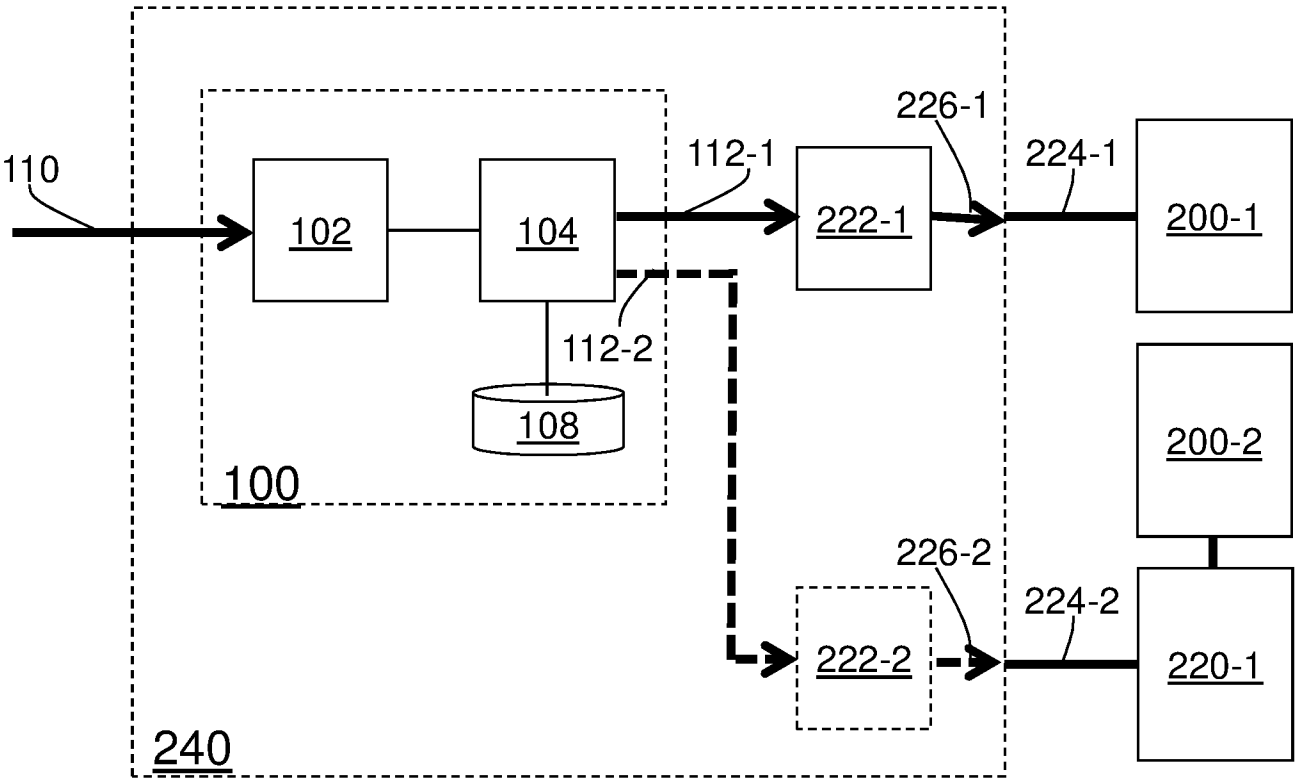

FIG. 2C illustrates an example system configuration in which an upstream device 240 incorporates a power management module (e.g., 100 of FIG. 1). The upstream device (240) may be a media source device, an upstream media encoder, an upstream media transcoder, etc., located remotely from one or more downstream devices such as a target display device 200-1, a set-top box 220-1, etc. In some embodiments, the set-top box (220-1) may be communicatively linked (e.g., via a HDMI connection, etc.) with a second target display device 200-2.

A decoding unit (e.g., 102 of FIG. 1 or FIG. 2C, etc.) in the upstream device (240) may receive an input media signal (e.g., 110, etc.), decode input media content from the input media signal (110), etc.

A power profile controller (e.g., 104 of FIG. 1 or FIG. 2C, etc.) may be configured to transform the input media content, as decoded by the decoding unit (102) from the input media signal (110), into one or more versions of power managed media content. For example, a first version of the power managed media content is generated from the input media content after one or more first power profiles specific to or specifically set up for the first target display device (200-1) are applied to the input media content. A second version of the power managed media content is generated from the input media content after one or more second power profiles specific to or specifically set up for the second target display device (200-2) are applied to the input media content.

Each of the one or more versions of the power managed media content may be used as output media content (e.g., 112-1, 112-2, etc.), and encoded by an encoding unit (e.g., 222-1, 222-2, etc.) into a corresponding output media signal (e.g., 226-1, 226-2, etc.). For example, the first version of the power managed media content may be used as the output media content (112-1), and encoded into a first output media signal 226-1; the second version of the power managed media content may be used as the output media content (112-2), and encoded into a second output media signal 226-1.

Each of the output media signals (e.g., 226-1 and 226-2, etc.) may be transmitted or distributed electronically by the upstream device (240) over one or more data connections (e.g., 224-1, 224-2, etc.) to one or more downstream devices, respectively. For example, the first output media signal (226-1) may be transmitted over a first data connection 226-1 to the target display device (200-1); the second output media signal (226-2) may be transmitted over a second data connection 226-2 to the set-top box (220-1), etc.

In some embodiments, the set-top box (220-1) may be configured to forward or relay the second output media signal (226-2) to the second target display device (200-2). In some other embodiments, the set-top box (220-1) may perform additional conversions, additional image processing operations, etc., on the second output media signal (226-2) to generate a new output media signal and send the new output media signal, in place of or in addition to the second output media signal (226-2), to a downstream device such as the second target display device (200-2), etc.

In some embodiments, the upstream device (240) may be preconfigured with power profiles for one or more target display devices (e.g., 200-1, 200-2, etc.), for example, in the power profile data repository (108) of the power management module (100) as incorporated in the upstream device (240). In some embodiments, the upstream device (240) may receive the power profiles for the target display devices (e.g., 200-1, 200-2, etc.) over the data connections (e.g., 224-1, 224-2, etc.), for example, from the target display device (200-1), the set-top box (220-1), the target display device (200-2), etc., in feedback data flows. In some embodiments, at least one of the power profiles for the target display devices (e.g., 200-1, 200-2, etc.) may be obtained by the upstream device (240) in real-time or near real-time. In some embodiments, a power profile as described herein may be at least in part configurable by a user of one or more of a target display device (e.g., 200-1, 200-2, etc.), a set-top box (e.g., 220-1, etc.), etc.

Additionally, optionally or alternatively, preprocessing and post processing steps (which may include, but are not limited only to, color space conversion, down sampling, upsampling, tone mapping, color grading, decompression, compression, etc.) may be performed by one or more of the upstream device (240), the set-top box (220-1), the target display devices (e.g., 200-1, 200-2, etc.), etc.

4. Constant Light Power Profiles

Figure 3B:
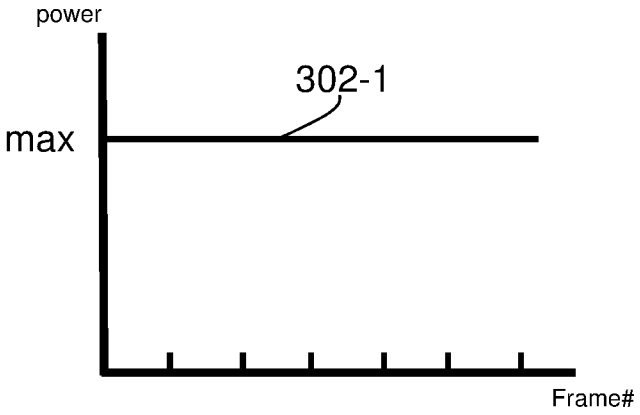
FIG. 3A through FIG. 3J illustrate example power profiles.
Figure 3A:
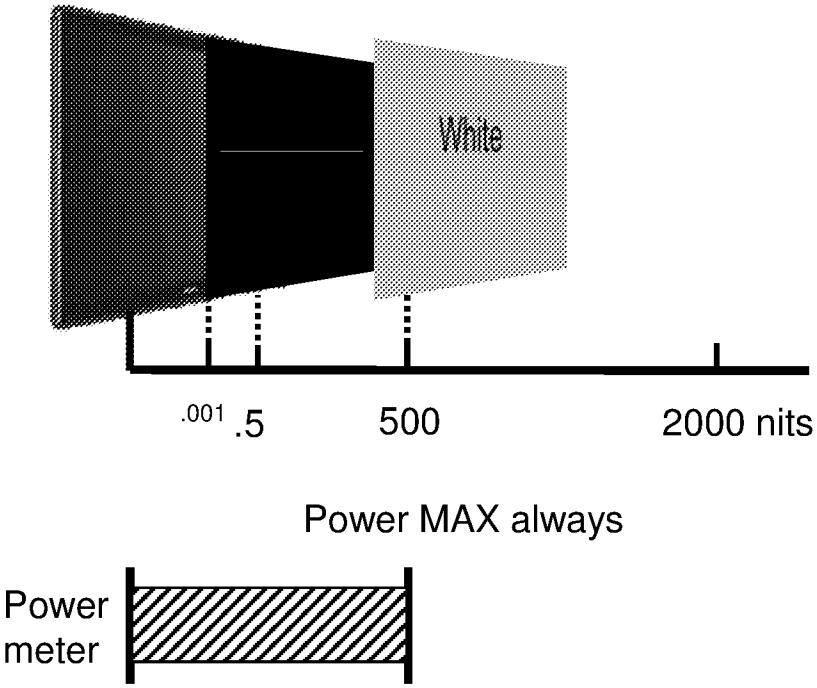

FIG. 3A and FIG. 3B illustrate an example constant light power profile 302-1 that may be specifically set up for a target display device (e.g., 200 of FIG. 2A, 200-1 of FIG. 2B or FIG. 2C, 200-2 of FIG. 2C, etc.). To operate with the constant light power profile (302-1), the target display device may set its light sources to illuminate each pixel with constant light intensity in rendering each image (as indexed by "Frame #" of FIG. 3B) and maintain the same constant light intensity for each pixel across all images. For example, the target display device may evenly distribute a full screen maximum power level (e.g., 100 Watts, etc.) for the light sources in terms of light intensity across each and every pixel so that the maximum luminance value (or maximum brightness level) of each such pixel is the same (e.g., 500 nits, etc.) as indicated in the power meter of FIG. 3A. Accordingly, the average power used to illuminate each and every pixel in this power profile may be the same (e.g., the full screen maximum power level, a "max" power level, etc.) in each image (as indexed by "Frame #" of FIG. 3B).

Maximum and minimum luminance values achievable for each pixel of an image in the constant light power profile (302-1) may define a constant luminance dynamic range for each such pixel. For example, when ambient light is absent, the minimum luminance value of the constant luminance dynamic range for each pixel may be 0.001 nits, which may correspond to the minimum light transmittance and/or reflectance settable in a pixel of the target display. When ambient light is present as is typical in a realistic viewing environment, the minimum luminance value of the constant luminance value range for each pixel may be raised, for example, to the ambient light level (e.g., 0.5 nits, etc.) as illustrated in FIG. 3A, even with each such pixel set to the minimum light transmittance and/or reflectance. Accordingly, the maximum (e.g., theoretical, etc.) contrast ratio may be 500 nits divided by 0.001 nits, or 500,000 times, assuming that ambient light is absent. In contrast, the maximum (e.g., actual, etc.) contrast ratio may be 500 nits/0.5 nits, or 1000 times, when ambient light is present in the viewing environment.

In some embodiments, a media signal as described herein may comprise image data having a reference luminance dynamic range that is (e.g., five times, ten times, over ten times, etc.) wider than the constant luminance dynamic range supported by the constant light power profile (302-1). For example, the reference luminance dynamic range may be delimited by (1) a minimum luminance value (e.g., 0.01 nits, etc.) lower than the minimum luminance value (e.g., 0.5 nits, etc.) in the constant light power profile (302-1) and (2) a maximum luminance value (e.g., 2,000 nits, etc.) greater than the maximum luminance value (e.g., 500 nits, etc.) in the constant light power profile (302-1). To render the image data with the reference luminance dynamic range in the constant light power profile (302-1), clipping operations, tone mapping operations, etc., may be performed to limit, map, etc., code values in the reference luminance dynamic range to clipped code values, tone mapped code values, etc., in the constant luminance dynamic range (e.g., between 0.5 nits and 500 nits, etc.) supported by the constant light power profile (302-1).

5. Global Dimming Power Profiles

Figure 3D:
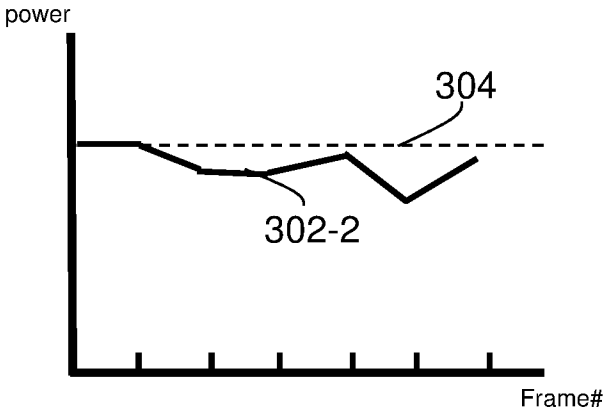
Figure 3C:
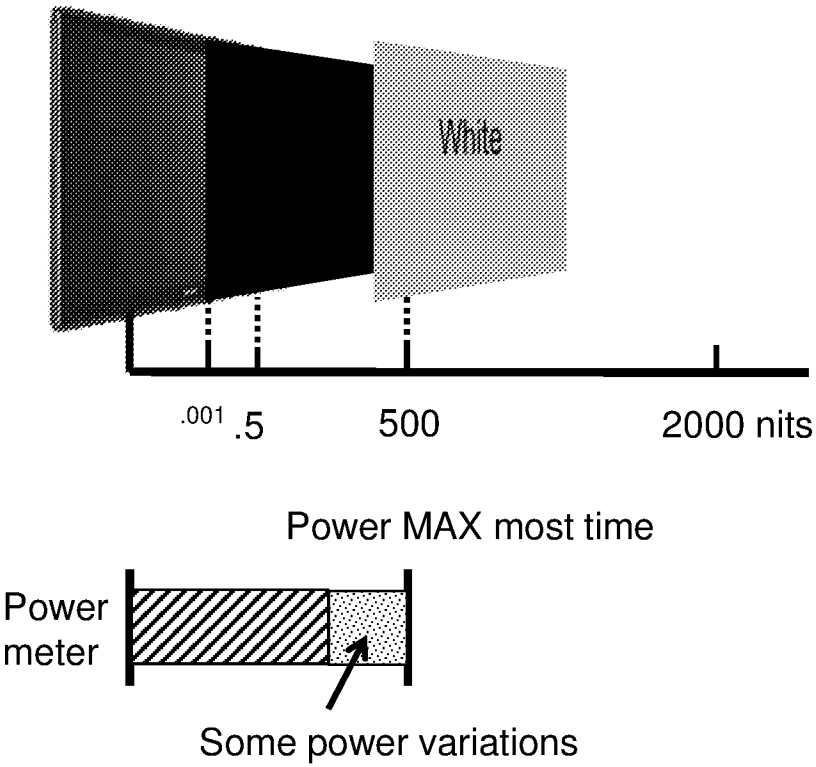

FIG. 3C and FIG. 3D illustrate an example global dimming power profile 302-2 that may be specifically set up for a target display device (e.g., 200 of FIG. 2A, 200-1 of FIG. 2B or FIG. 2C, 200-2 of FIG. 2C, etc.). In the global dimming power profile, illumination across all pixels within a single image is held to be the same light intensity, while illumination across different images, different image groups, etc., may have varying light intensities depending on image data.

A power management module (e.g., 100 of FIG. 1, etc.) that operates with the global dimming power profile (302-2) may determine individual maximum luminance values, individual minimum luminance values, etc., for individual images (as indexed by "Frame #" of FIG. 3D), individual image groups (e.g., in individual scenes, etc.), etc., represented in image data decoded from a media signal.

The individual maximum luminance values, individual minimum luminance values, etc., may be provided by the power management module (100) as power management parameters in output media content (e.g., 112 of FIG. 1, 112 of FIG. 2A, etc.) to a downstream unit, module, device, etc. Additionally, optionally, or alternatively, these power management parameters may be included as metadata in an output media signal (e.g., 226 of FIG. 2B, 226-1 or 226-2 of FIG. 2C, etc.).

Based on the power management parameters, the target display device may be configured to set its light sources to generate sufficient illumination for the individual images, the individual image groups, etc., to produce the individual maximum luminance values, the individual minimum luminance values, etc., when pixels are set to (or below a safe margin from) the maximum light transmittance and/or reflectance.

Depending on the individual maximum luminance values, the individual minimum luminance values, etc., the target display device may adjust or vary the illumination from image to image, from image group to image group, etc. However, for each individual image, each pixel illuminated with the same light intensity.

As indicated in the power meter of FIG. 3C, the target display device that operates in the global dimming power profile (302-2) may generate some power variations below a full screen maximum power level (e.g., 100 Watts, corresponding to 500 nits across all pixels, etc.) for the light sources. Accordingly, the average power to illuminate different images in this power profile (302-2) may be variable and better than that in the constant light power profile (302-1) as illustrated in FIG. 3B. In the meantime, the global dimming power profile (302-2) is capable of supporting the same luminance dynamic range for each pixel as the constant luminance dynamic range supported by the constant light power profile (302-1) of FIG. 3B.

Accordingly, as in the case of the constant light power profile (302-1), in order to render the image data with a reference luminance dynamic range that has a wider dynamic range than supported by the global dimming power profile (302-2), the target display device may perform clipping operations, tone mapping operations, etc., to limit, map, etc., code values in the reference luminance dynamic range to clipped code values, tone mapped code values, etc., within the dynamic range (e.g., between 0.5 nits and 500 nits, etc.) supported by the global dimming power profile (302-2).

6. Local Dimming Power Profiles

Figure 3F:
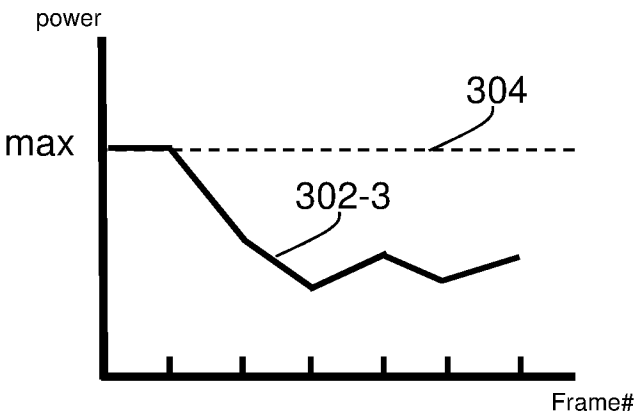
Figure 3E:
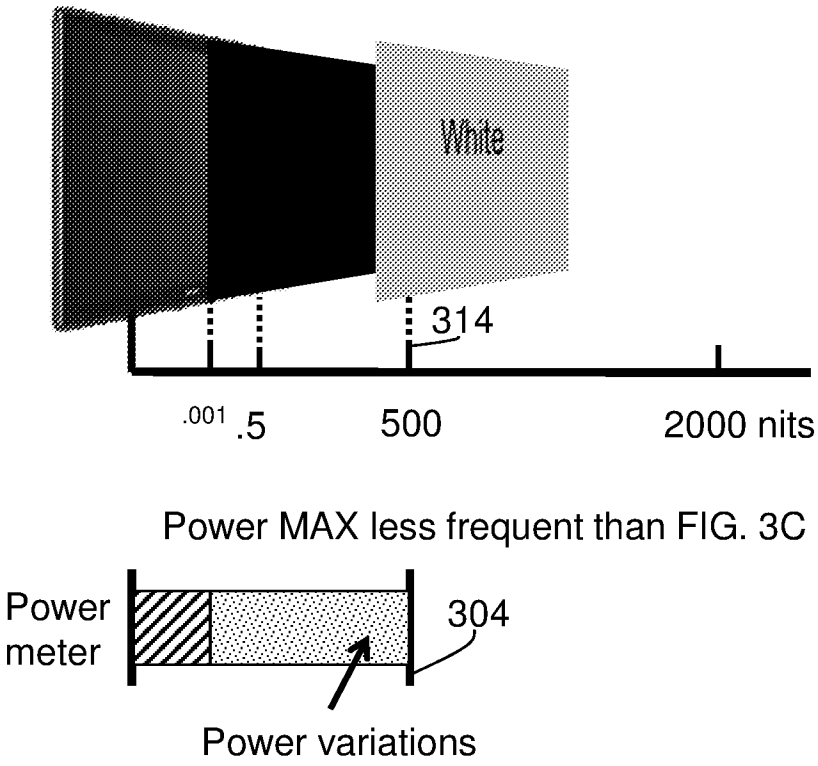

FIG. 3E and FIG. 3F illustrate an example local dimming power profile 302-3 that may be specifically set up for a target display device (e.g., 200 of FIG. 2A, 200-1 of FIG. 2B or FIG. 2C, 200-2 of FIG. 2C, etc.). In the local dimming power profile (302-3), an image may be partitioned into multiple spatial regions. Different images may be partitioned into different sets of spatial regions, which may or may not be the same shape, the same size, etc. Illumination across all pixels within each spatial region of a single image is held to be the same light intensity, while illumination across different spatial regions of an image, across different sets of spatial regions in different images, across different sets of spatial regions in different image groups, etc., may have different light intensities, depending on image data.

A power management module (e.g., 100 of FIG. 1, FIG. 2A, FIG. 2B, FIG. 2C, etc.) that operates with the local dimming power profile (302-3) may partition an image (among a plurality of images decoded from a media signal and as indexed by "Frame #" of FIG. 3F) into a plurality of spatial regions, determine individual maximum luminance values, individual minimum luminance values, etc., for each spatial region in the plurality of spatial regions in individual images, in individual image groups (e.g., in individual scenes, etc.), etc., as represented in image data decoded from a media signal.

The (e.g., spatial region dependent, etc.) individual maximum luminance values, individual minimum luminance values, etc., may be provided by the power management module (100) as power management parameters in output media content (e.g., 112 of FIG. 1, 112 of FIG. 2A, etc.) to a downstream unit, module, device, etc. Additionally, optionally, or alternatively, these power management parameters may be included as metadata (or power management metadata) in an output media signal (e.g., 226 of FIG. 2B, 226-1 or 226-2 of FIG. 2C, etc.) to a downstream unit, module, device, etc.

Maximum luminance values of any pixel in any spatial regions of an image under the local dimming power profile (302-3) are capped at or below a full screen maximum luminance value 314 (e.g., 500 nits as indicated in FIG. 3E, etc.). Power consumption under the local dimming power profile (302-3) reaches a full screen maximum power level (e.g., 304 of FIG. 3E or FIG. 3F, etc.) when all spatial regions of an image have pixels of the same brightness level at the full screen maximum luminance value (314).

Based on the power management parameters that are dependent on image data in individual spatial regions, the target display device may be configured to set its light sources assigned to spatial regions to generate sufficient illumination for each spatial region in a plurality of regions in the individual images, in the individual image groups, etc., to produce the individual maximum luminance values up to the full screen maximum luminance value (314), the individual minimum luminance values, etc., as signaled by the power profile management profile (100) when pixels are set to (or below a safe margin from) the maximum light transmittance and/or reflectance.

Depending on the individual maximum luminance values, the individual minimum luminance values, etc., the target display device may adjust or vary light intensities of illumination from spatial region to spatial region, from image to image, from image group to image group, etc. However, for each spatial region in a plurality of spatial regions, each pixel is illuminated with the same light intensity under the local dimming power profile (302-3).

As indicated in the power meter of FIG. 3E, the target display device that operates in the local dimming power profile (302-3) may generate power variations, which can be significantly more than the power variations generated in the global dimming power profile (302-2).

For example, an image may comprise only a block of bright pixels that comprise luminance values near (e.g., no less than, etc.) the maximum luminance value (314); the rest of pixels in the image may be dark pixels comprising very low luminance values. Under the global dimming power profile (302-2), all the pixels would be illuminated with the same light intensity that allows each pixel, whether bright or dark, to be capable of generating the same brightness level as the brightest pixels (e.g., up to the maximum luminance value 314, etc.) in the image. Thus, there would be much power waste under the global dimming power profile (302-2) if the image contains very few bright pixels. On the other hand, under the local dimming power profile (302-3), the image may be partitioned into multiple spatial regions. The block of bright pixels can be set in a specific spatial region by itself, and only the specific spatial region needs to be illuminated with the same light intensity that allows each pixel in the specific spatial region to be capable of generating the same brightness level as the brightest pixels (e.g., up to the maximum luminance value 314, etc.) in the image. Other spatial regions can be illuminated with low or minimal light intensities under the local dimming power profile (302-3).

Accordingly, the average power to illuminate different images in the local dimming power profile (302-3) may be variable and significantly better than that in the constant light power profile (302-1) as illustrated in FIG. 3B or in the global dimming power profile (302-2) as illustrated in FIG. 3D. In the meantime, the local dimming power profile (302-3) is capable of supporting the same luminance dynamic range for each pixel as the constant luminance dynamic range supported by the constant light power profile (302-1) of FIG. 3B, or supported by the global dimming power profile (302-2) of FIG. 3D.

As in the cases of the constant light power profile (302-1) of FIG. 3B and the global dimming power profile (302-2) of FIG. 3D, in order to render the image data with a reference luminance dynamic range that has a wider dynamic range that supported by the local dimming power profile (302-3), the target display device may perform clipping operations, tone mapping operations, etc., to limit, map, etc., code values in the reference luminance dynamic range to clipped code values, tone mapped code values, etc., within the dynamic range (e.g., between 0.5 nits and 500 nits, etc.) supported by the local dimming power profile (302-3).

7. Highlight Local Dimming Power Profiles

Figure 3H:
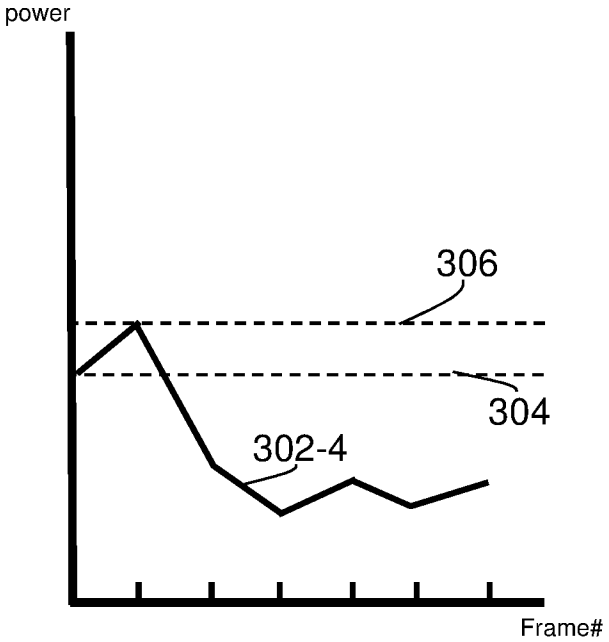
Figure 3G:
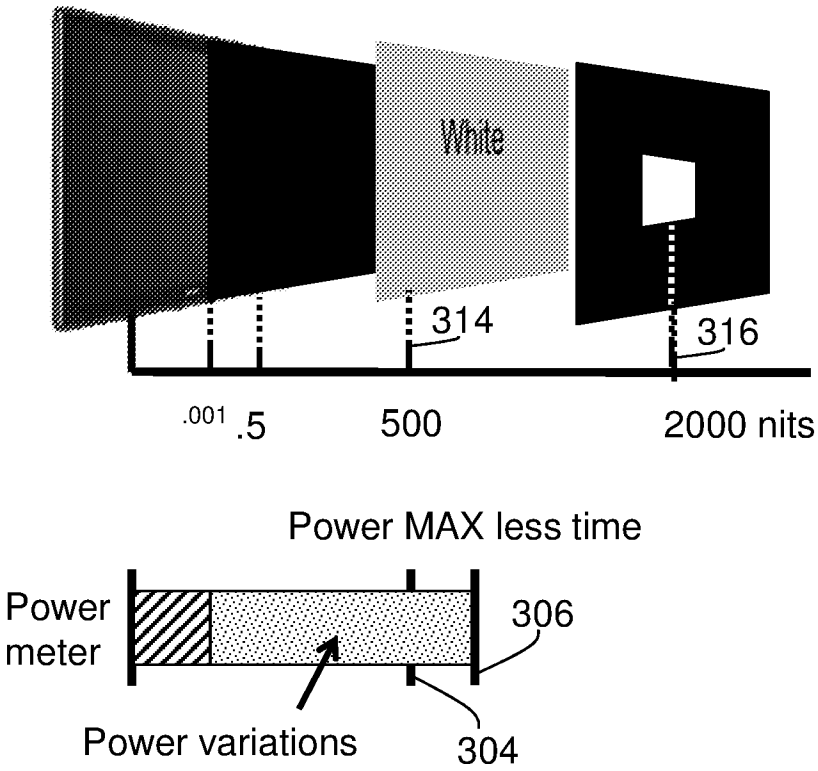

FIG. 3G and FIG. 3H illustrate an example type I highlight local dimming (or local dimming with highlight) power profile 302-4 that may be specifically set up for a target display device (e.g., 200 of FIG. 2A, 200-1 of FIG. 2B or FIG. 2C, 200-2 of FIG. 2C, etc.). In type I highlight local dimming power profile (302-4), an image may be partitioned into multiple spatial regions. Different images may be partitioned into different sets of spatial regions, which may or may not be the same shape, the same size, etc. Illumination across all pixels within each spatial region of a single image is held to be the same light intensity, while illumination across different spatial regions of an image, across different sets of spatial regions in different images, across different sets of spatial regions in different image groups, etc., may have different light intensities, depending on image data.

A power management module (e.g., 100 of FIG. 1, FIG. 2A, FIG. 2B, FIG. 2C, etc.) that operates with type I highlight local dimming power profile (302-4) may partition an image (among a plurality of images decoded from a media signal and as indexed by "Frame #" of FIG. 3H) into a plurality of spatial regions, determine individual maximum luminance values, individual minimum luminance values, etc., for each spatial region in the plurality of spatial regions in individual images, in individual image groups (e.g., in individual scenes, etc.), etc., as represented in image data decoded from a media signal.

In some embodiments, the (e.g., spatial region dependent, etc.) individual maximum luminance values, individual minimum luminance values, etc., may be provided by the power management module (100) as power management parameters in output media content (e.g., 112 of FIG. 1, 112 of FIG. 2A, etc.) to a downstream unit, module, device, etc. For example, the power management module (100) may be incorporated in the target display device and may provide these power management parameters to a downstream module in the target display device.

Additionally, optionally, or alternatively, these power management parameters may be included as metadata (or power management metadata) in an output media signal (e.g., 226 of FIG. 2B, 226-1 or 226-2 of FIG. 2C, etc.) to a downstream unit, module, device, etc. For example, the power management module (100) may be incorporated in a device (e.g., a set-top box, an upstream device, etc.) separate from the target display device and may provide these power management parameters to a downstream device such as an intermediate device, a set-top device, the target display device, etc.

Figure 5:
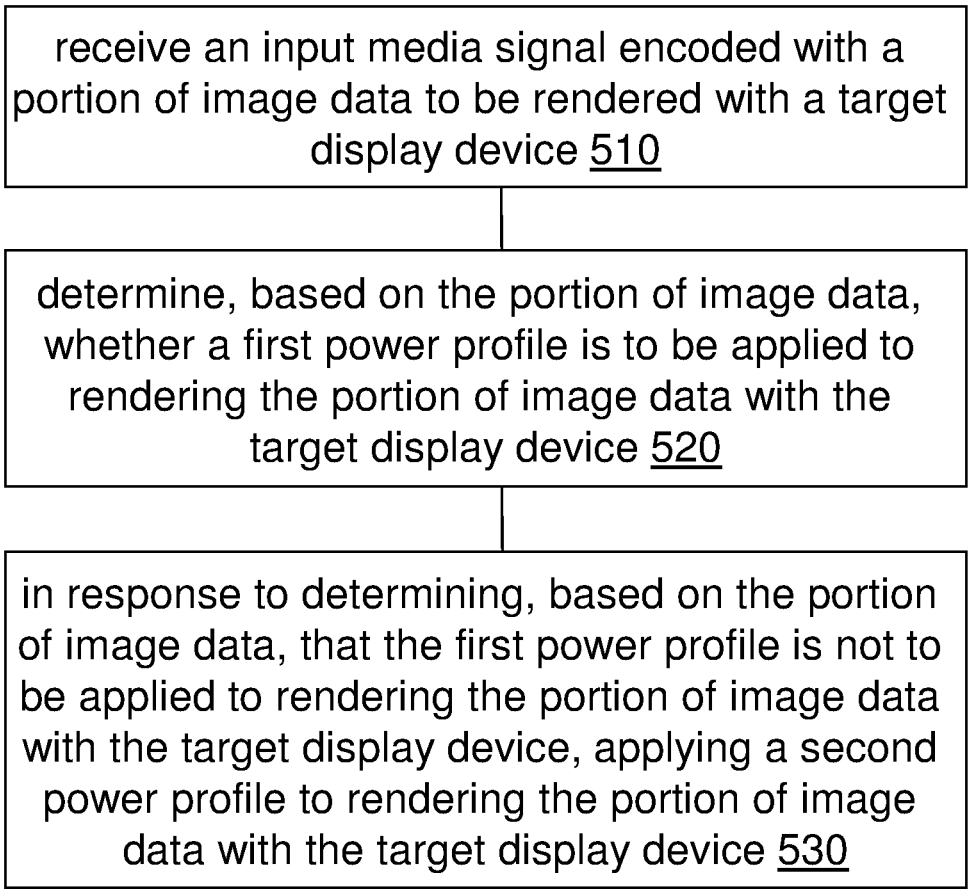
FIG. 5 illustrates an example process flow.

Under type I highlight local dimming power profile (302-4), so long as power consumption of illuminating all pixels of an image is capped at or below a highlight peak power limit (e.g., 306 of FIG. 3G or FIG. 3H, etc.), maximum luminance values of any pixel in any spatial regions of the image can reach up to a highlight peak luminance limit 316 (e.g., 2,000 nits as indicated in FIG. 3G, 5,000 nits, 10,000 nits, 20,000 nits or more, etc.), which may be set to (e.g., five times, ten times, twenty times or more, etc.) higher than a full screen maximum luminance value 314 (e.g., 100 nits, 300 nits, 500 nits as indicated in FIG. 3G, 1,000 nits, 2,000 nits, etc.). The highlight peak power limit (306) can be set to be (e.g., 10%, 12%, 14%, etc.) higher than a full screen maximum power level 304, the latter of which corresponds to a power consumption level when all spatial regions of an image have pixels of the same brightness level at the full screen maximum luminance value (314). Thus, under type I highlight local dimming power profile, so long as the power consummation of illuminating all pixels of the image is no more than the highlight peak power limit (306), the image can be (e.g., faithfully, etc.) rendered to the full dynamic range as represented within the image up to the highlight peak luminance limit (316).

Based on the power management parameters that are dependent on image data in individual spatial regions, the target display device may be configured to set its light sources assigned to spatial regions to generate sufficient illumination for each spatial region in a plurality of regions in the individual images, in the individual image groups, etc., to produce the individual maximum luminance values—if the power consumption of illuminating all pixels of a given image is capped at or below the highlight peak power limit (306)—up to the highlight peak luminance limit (316), the individual minimum luminance values, etc., as signaled by the power profile management profile (100) when pixels are set to (or below a safe margin from) the maximum light transmittance and/or reflectance.

Depending on the individual maximum luminance values, the individual minimum luminance values, etc., the target display device may adjust or vary light intensities of illumination from spatial region to spatial region, from image to image, from image group to image group, etc. However, for each spatial region in a plurality of spatial regions, each pixel may be illuminated with the same light intensity under type I local dimming power profile (302-4).

As indicated in the power meter of FIG. 3G, the target display device that operates in type I local dimming power profile (302-4) may generate power variations, which can be significantly more than the power variations generated in the global dimming power profile (302-2) and in the local dimming power profile (302-3). Accordingly, the average power to illuminate different images in type I local dimming power profile (302-4) may be variable and significantly better than that in the constant light power profile (302-1) as illustrated in FIG. 3B and in the global dimming power profiles (302-2) as illustrated in FIG. 3D, when no pixels have luminance values higher than the full screen maximum luminance value (314). In the meantime, type I local dimming power profile (302-4) is capable of supporting a much higher luminance dynamic range (e.g., between 0.5 nit and 2,000 nits, etc.) up to the highlight peak luminance limit (316) than the luminance dynamic range (e.g., between 0.5 nit and 500 nits, etc.) supported by the constant light power profile (302-1) of FIG. 3B, the global dimming power profile (302-2) of FIG. 3D, or the local dimming power profile (302-3) of FIG. 3F, so long as power consumption of illuminating all pixels of an image is capped at or below the highlight peak power limit (306).

In some embodiments, the power management module (100) may be configured to determine whether power consumption of illuminating all pixels of an image based on luminance values as represented in received image data by the target display device exceeds the highlight peak power limit (306). In response to determining that the power consumption of illuminating all pixels of the image based on the luminance values as represented in the received image data by the target display device exceeds the highlight peak power limit (306), the power management module (100) may be configured to determine a set of spatial regions each of which comprises pixels with brightness levels greater than the full screen maximum luminance value (314); determine or compute a highlight peak luminance value at or below the highlight peak luminance limit (316) based at least in part on the size of highlighted areas as represented in the set of spatial regions that compromise pixels with brightness levels greater than the full screen maximum luminance value (314); generate one or more specific power management metadata portions that indicate the highlight peak luminance value; etc. The one or more specific power management metadata portions may be provided by the power management module (100) as power management parameters in output media content (e.g., 112 of FIG. 1, 112 of FIG. 2A, etc.) to a downstream unit, module, device, etc. Additionally, optionally, or alternatively, the one or more specific power management metadata portions may be included as metadata (or power management metadata) in an output media signal (e.g., 226 of FIG. 2B, 226-1 or 226-2 of FIG. 2C, etc.) to a downstream unit, module, device, etc.

Based at least in part on the one or more specific power management metadata portions that indicate the highlight peak luminance value, the target display device may be configured to set its light sources assigned to spatial regions to generate sufficient illumination for each spatial region in the highlighted areas of the image to produce the individual maximum luminance values up to the highlight peak luminance limit (316), the individual minimum luminance values, etc., as signaled by the power profile management profile (100) when pixels are set to (or below a safe margin from) the maximum light transmittance and/or reflectance. In some embodiments, while individual light intensities of some spatial regions in the highlighted areas may exceed the highlight peak luminance value, and individual light intensities of some other spatial regions in the highlighted areas may be no more than the highlight peak luminance value, a group luminance value of all these individual light intensities in the highlighted areas may be constrained to be the same as, or no more than, the highlight peak luminance value.

By way of example and not limitation, the highlight peak power limit (306) may be 12% more than the full screen maximum power level (304). The more the highlight peak power limit (306) is raised above the full screen maximum power level (304), the more extra power consumption is available for illuminating pixels in the highlighted areas, hence the higher the highlight peak luminance limit can be raised.

In the present example, up to approximately 4% of all pixels in an image may be set to four times of the full screen maximum luminance value, or the highlight peak luminance limit (316) as illustrated in FIG. 3G and FIG. 3H, while the remaining 96% of all pixels in the image may be set up to the full screen maximum luminance value (314), without causing the power consumption for illuminating the entire image to exceed the highlight peak power limit (306).

If the set of spatial regions each of which comprises brightness levels greater than the full screen maximum luminance value (314) comprises no more than 4% of all pixels in an image, then the power level difference between the full screen maximum power level (304) and the highlight peak power limit (306) is sufficient to be used to illuminate all spatial regions of the image including the set of spatial regions.

On the other hand, if the set of spatial regions each of which comprises brightness levels greater than the full screen maximum luminance value (314) comprises more than 4% of all pixels in an image, then the power level difference between the full screen maximum power level (304) and the highlight peak power limit (306) can be used to illuminate the highlighted areas in the set of spatial regions up to the highlight peak luminance limit (316) while illuminating all other spatial regions of the image up to the full screen maximum luminance value (314). However, a group luminance value of all these individual light intensities in the highlighted areas may be constrained to the highlight peak luminance value, which is below the highlight peak luminance limit (316) in this scenario. In some embodiments, the target display device may perform clipping operations, tone mapping operations, etc., to limit, map, adjust, etc., luminance values in the highlighted areas to lowered luminance values such that the group luminance value in a distribution of the lowered luminance values equals to, or is less than, the highlight peak luminance value below the highlight peak luminance limit (316).

8. Adaptable Full Screen Maximum Luminance Value

Figure 3J:
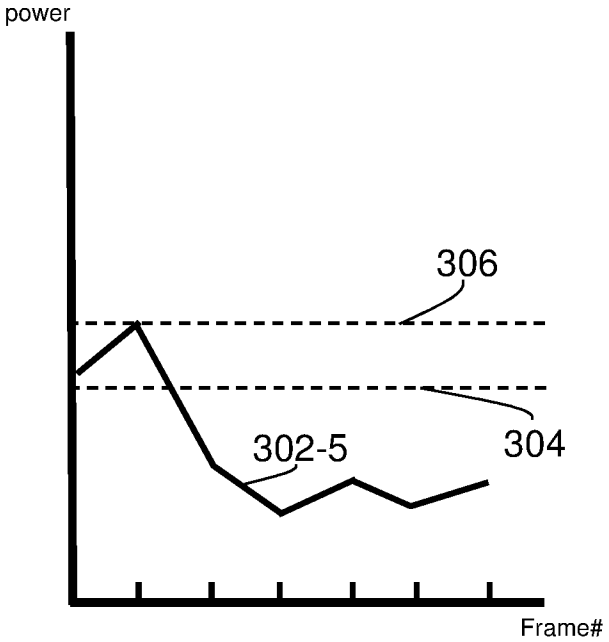
Figure 3I:
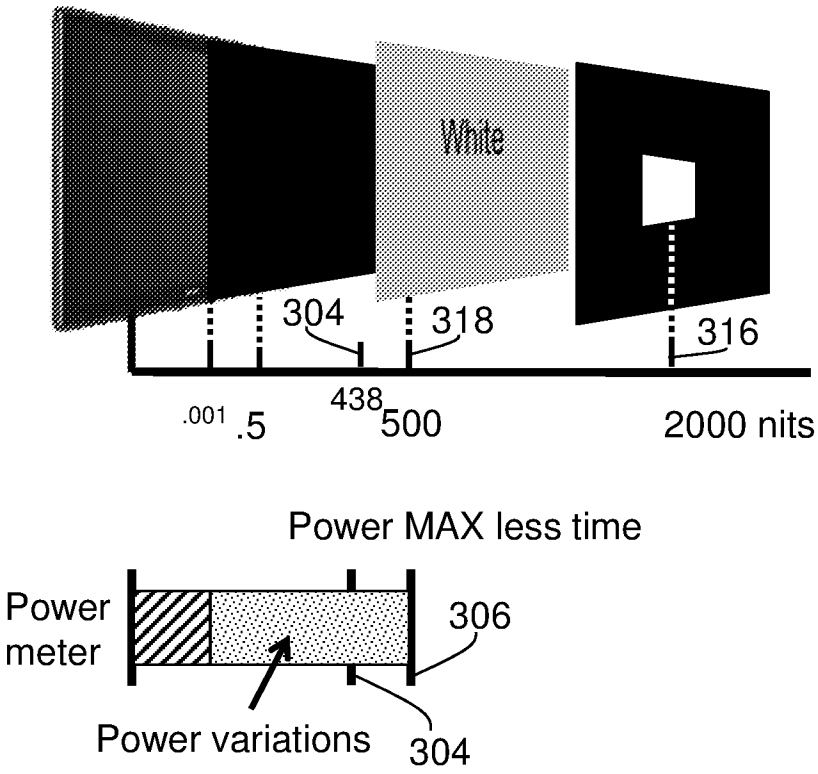

FIG. 3I and FIG. 3J illustrate an example type II highlight local dimming (or local dimming with highlight and constant power) power profile 302-5 that may be specifically set up for a target display device (e.g., 200 of FIG. 2A, 200-1 of FIG. 2B or FIG. 2C, 200-2 of FIG. 2C, etc.). In type II highlight local dimming power profile (302-5), an image may be partitioned into multiple spatial regions. Different images may be partitioned into different sets of spatial regions, which may or may not be the same shape, the same size, etc. Illumination across all pixels within each spatial region of a single image is held to be the same light intensity, while illumination across different spatial regions of an image, across different sets of spatial regions in different images, across different sets of spatial regions in different image groups, etc., may have different light intensities, depending on image data.

A power management module (e.g., 100 of FIG. 1, FIG. 2A, FIG. 2B, FIG. 2C, etc.) that operates with type II highlight local dimming power profile (302-5) may partition an image (among a plurality of images decoded from a media signal and as indexed by "Frame #" of FIG. 3J) into a plurality of spatial regions, determine individual maximum luminance values, individual minimum luminance values, etc., for each spatial region in the plurality of spatial regions in individual images, in individual image groups (e.g., in individual scenes, etc.), etc., as represented in image data decoded from a media signal.

In some embodiments, the (e.g., spatial region dependent, etc.) individual maximum luminance values, individual minimum luminance values, etc., may be provided by the power management module (100) as power management parameters in output media content (e.g., 112 of FIG. 1, 112 of FIG. 2A, etc.) to a downstream unit, module, device, etc. For example, the power management module (100) may be incorporated in the target display device and may provide these power management parameters to a downstream module in the target display device.

Additionally, optionally, or alternatively, these power management parameters may be included as metadata (or power management metadata) in an output media signal (e.g., 226 of FIG. 2B, 226-1 or 226-2 of FIG. 2C, etc.) to a downstream unit, module, device, etc. For example, the power management module (100) may be incorporated in a device (e.g., a set-top box, an upstream device, etc.) separate from the target display device and may provide these power management parameters to a downstream device such as an intermediate device, a set-top device, the target display device, etc.

Under type II highlight local dimming power profile (302-5), so long as power consumption of illuminating all pixels of an image is capped at or below a highlight peak power limit (e.g., 306 of FIG. 3I or FIG. 3J, etc.), maximum luminance values of any pixel in any spatial regions of the image can reach up to a highlight peak luminance limit 316 (e.g., 2,000 nits as indicated in FIG. 3I, 5,000 nits, 10,000 nits, 20,000 nits or more, etc.), which may be set to (e.g., five times, ten times, twenty times or more, etc.) higher than a full screen maximum luminance limit 318 (e.g., 100 nits, 300 nits, 500 nits as indicated in FIG. 3G, 1,000 nits, 2,000 nits, etc.). The highlight peak power limit (306) can be set to be the same as a full screen peak power limit when all pixels of the image is illuminated with the same light intensity that corresponds to the full screen maximum luminance limit (318). Thus, under type II highlight local dimming power profile, so long as the power consummation of illuminating all pixels of the image is no more than the highlight peak power limit (306), the image can be faithfully rendered to the full dynamic range as represented within the image up to the highlight peak luminance limit (316).

Based on the power management parameters that are dependent on image data in individual spatial regions, the target display device may be configured to set its light sources assigned to spatial regions to generate sufficient illumination for each spatial region in a plurality of regions in the individual images, in the individual image groups, etc., to produce the individual maximum luminance values—if the power consumption of illuminating all pixels of a given image is capped at or below the highlight peak power limit (306)—up to the highlight peak luminance limit (316), the individual minimum luminance values, etc., as signaled by the power profile management profile (100) when pixels are set to (or below a safe margin from) the maximum light transmittance and/or reflectance.

Depending on the individual maximum luminance values, the individual minimum luminance values, etc., the target display device may adjust or vary light intensities of illumination from spatial region to spatial region, from image to image, from image group to image group, etc. However, for each spatial region in a plurality of spatial regions, each pixel is illuminated with the same light intensity under type II local dimming power profile (302-5).

As indicated in the power meter of FIG. 3I, the target display device that operates in type II local dimming power profile (302-5) may generate power variations, which can be significantly more than the power variations generated in the global dimming power profile (302-2) and in the local dimming power profile (302-3). Accordingly, the average power to illuminate different images in type II local dimming power profile (302-5) may be variable and significantly better than that in the constant light power profile (302-1) as illustrated in FIG. 3B and in the global dimming power profiles (302-2) as illustrated in FIG. 3D, when no pixels have luminance values higher than the full screen maximum luminance limit (318). In the meantime, type II local dimming power profile (302-5) is capable of supporting a much higher luminance dynamic range (e.g., between 0.5 nit and 2,000 nits, etc.) than the luminance dynamic range (e.g., between 0.5 nit and 500 nits, etc.) supported by the constant light power profile (302-1) of FIG. 3B, the global dimming power profile (302-2) of FIG. 3D, or the local dimming power profile (302-3) of FIG. 3F, so long as power consumption of illuminating all pixels of an image is capped at or below the highlight peak power limit (306).

In some embodiments, the power management module (100) may be configured to determine whether power consumption of illuminating all pixels of an image based on luminance values as represented in received image data by the target display device exceeds the highlight peak power limit (306). In response to determining that the power consumption of illuminating all pixels of the image based on the luminance values as represented in the received image data by the target display device exceeds the highlight peak power limit (306), the power management module (100) may be configured to determine a set of spatial regions each of which comprises pixels with brightness levels greater than the full screen maximum luminance limit (318); determine or compute a highlight peak luminance value at or below the highlight peak luminance limit (316) and a full screen maximum luminance value 314 below the full screen maximum luminance (318), based at least in part on the size of highlighted areas as represented in the set of spatial regions that compromise pixels with brightness levels greater than the full screen maximum luminance limit (318); generate one or more specific power management metadata portions that indicate the highlight peak luminance value, the full screen maximum luminance value (314), etc.; etc. The one or more specific power management metadata portions may be provided by the power management module (100) as power management parameters in output media content (e.g., 112 of FIG. 1, 112 of FIG. 2A, etc.) to a downstream unit, module, device, etc. Additionally, optionally, or alternatively, the one or more specific power management metadata portions may be included as metadata (or power management metadata) in an output media signal (e.g., 226 of FIG. 2B, 226-1 or 226-2 of FIG. 2C, etc.) to a downstream unit, module, device, etc.

Based at least in part on the one or more specific power management metadata portions that indicate the highlight peak luminance value, the full screen maximum luminance value (314), etc., the target display device may be configured to set its light sources assigned to spatial regions to generate sufficient illumination for each spatial region in the highlighted areas of the image to produce the individual maximum luminance values up to the highlight peak luminance limit (316), the individual minimum luminance values, etc., as signaled by the power profile management profile (100) when pixels are set to (or below a safe margin from) the maximum light transmittance and/or reflectance. In some embodiments, while individual light intensities of some spatial regions in the highlighted areas may exceed the highlight peak luminance value, and individual light intensities of some other spatial regions in the highlighted areas may be no more than the highlight peak luminance value, a group luminance value of all these individual light intensities in the highlighted areas may be constrained to be the same as, or no more than, the highlight peak luminance value. Similarly, in some embodiments, while individual light intensities of some spatial regions in the non-highlighted areas may exceed the full screen maximum luminance value (314), and individual light intensities of some other spatial regions in the highlighted areas may be no more than the full screen maximum luminance value (314), a group luminance value of all these individual light intensities in the highlighted areas may be constrained to be the same as, or no more than, the full screen maximum luminance value (314).

By way of example and not limitation, the highlight peak power limit (306) may be the same as the full screen maximum power limit. The lower the full screen maximum luminance value (314) is lowered below the full screen maximum luminance limit (318), the more extra power consumption is available for illuminating pixels in the highlighted areas, hence the higher the highlight peak luminance limit can be raised.

In the present example, up to a threshold number of pixels (e.g., approximately 4% of all pixels, etc.) in an image may be set to four times of the full screen maximum luminance limit (318), or the highlight peak luminance limit (316) as illustrated in FIG. 3I and FIG. 3J, while the remaining number of pixels (e.g., approximately 96% of all pixels, etc.) in the image may be set up to the full screen maximum luminance value (314), without causing the power consumption for illuminating the entire image to exceed the highlight peak power limit (306).

If the set of spatial regions each of which comprises brightness levels greater than the full screen maximum luminance value (314) comprises no more than the threshold number of all pixels in an image, then all spatial regions in the set of spatial regions can be illuminated up to the highlight peak luminance limit (316). All other spatial regions of the image can be illuminated up to the full screen maximum luminance value (314).

Thus, if the set of spatial regions each of which comprises brightness levels greater than the full screen maximum luminance value (314) comprises no more than the threshold number of all pixels in an image, then the power saving from lowering the full screen maximum luminance value (314) below the full screen maximum luminance limit (318) is sufficient to be used to illuminate all spatial regions of the image including the set of spatial regions, so long as the overall power consumption is no more than the highlight peak power limit (306). In some embodiments, the threshold number of all pixels in the image may be equivalently represented by (or linearly proportional to) a highlight peak area size limit (e.g., 320 of FIG. 4, etc.).

On the other hand, if the set of spatial regions each of which comprises brightness levels greater than the full screen maximum luminance value (314) comprises more than the threshold number of all pixels in the image, then the power saving from lowering the full screen maximum luminance value (314) for the non-highlighted areas of the image can be used to illuminate the highlighted areas in the set of spatial regions up to the highlight peak luminance limit (316) while illuminating all other spatial regions of the image up to the full screen maximum luminance value (314). However, a group luminance value of all these individual light intensities in the highlighted areas may be constrained to the highlight peak luminance value, which is below the highlight peak luminance limit (316) in this scenario. Similarly, a group luminance value of all individual light intensities in the non-highlighted areas may be constrained to the full screen maximum luminance value (314), which is below the full screen maximum luminance limit (318) in this scenario. In some embodiments, the target display device may perform clipping operations, tone mapping operations, etc., to limit, map, adjust, etc., luminance values in the image to lowered luminance values such that the group luminance value in a distribution of the lowered luminance values in the highlighted areas equals to, or is less than, the highlight peak luminance value below the highlight peak luminance limit (316) and that the group luminance value in a distribution of the lowered luminance values in the non-highlighted areas equals to, or is less than, the full screen maximum luminance value (314) below the full screen luminance limit (318).

Figure 4:
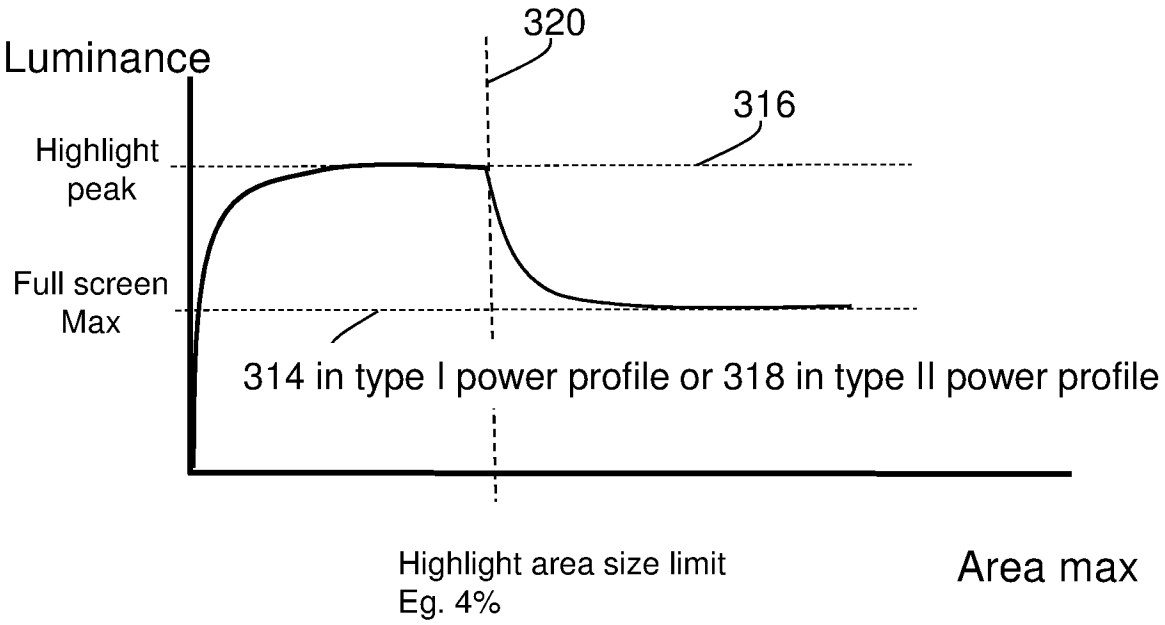
FIG. 4 illustrates an example chart depicting a relationship between a group luminance value in highlighted areas and a size of the highlighted areas.

FIG. 4 illustrates a chart depicting an example relationship between a group luminance value of pixels in highlighted areas as represented by the vertical axis ("Luminance") of the chart and the size of the highlighted areas as represented by the horizontal axis ("Area max") of the chart.

As used herein, the highlighted areas may refer to a set of spatial regions in an image that comprise pixels with brightness levels exceeding a full screen maximum luminance value (e.g., 314 of FIG. 3G, etc.) in a type I highlight local dimming power profile (e.g., 302-4, etc), or exceeding a full screen luminance limit (e.g., 318 of FIG. 3I, etc.) in a type II highlight local dimming power profile (e.g., 302-5, etc). In some embodiments, in the highlighted areas of the image, the number of pixels may be monotonically dependent on (e.g., linearly proportional to, etc.) the size of the highlighted areas ("Area max").

A group luminance value (e.g., in non-highlighted areas, in highlighted areas, etc.) may be a statistical value. The group luminance value in the highlighted areas as represented in the chart of FIG. 4 may refer to the largest maximum luminance value in some or all spatial regions in the highlighted areas, the average maximum luminance value in some or all spatial regions in the highlighted areas, the medium maximum luminance value in some or all spatial regions in the highlighted areas, etc. Individual luminance values of individual pixels in the highlighted areas, individual maximum luminance values in individual spatial regions in the highlighted areas of the image, etc., may be different, depending on image data and/or clipping/tone mapping operations. In some embodiments, the group luminance value represented by the vertical axis ("Luminance") of the chart of FIG. 4 may be computed (e.g., as an average, etc.) from a distribution of maximum luminance values in some or all spatial regions in the highlighted areas.

In some embodiments, extra power consumption used to illuminate the highlighted areas of the image may be estimated or represented as (e.g., a quantity linearly proportional to, etc.) the product of a first quantity multiplied by a second quantity, where the first quantity may be the difference between the full screen luminance limit (318) in type II highlight local dimming power profiles (or the full screen luminance value 314 in type I highlight local dimming power profiles) and the group luminance value as represented by the vertical axis of the chart in FIG. 4, and where the second quantity may be the size of the highlighted areas as represented by the horizontal axis of the chart in FIG. 4.

In some embodiments, when the size of the highlighted areas in the image is no larger than a highlight area size limit 320 (e.g., 4% of the full screen of a target display device which corresponds to 4% of total number of pixels of the target display device, etc.), all luminance values up to a highlight peak luminance limit (e.g., 316, etc.) in the image including the highlighted areas can be rendered by a target display device that implements power management techniques as described herein.

In some embodiments, when the size of the highlighted areas in the image is above the highlight area size limit (320), depending on image data, not all luminance values in the image can be rendered up to the highlight peak luminance limit (316) as represented in the image data by a target display device that implements power management techniques as described herein. In these embodiments, the highlighted area may be illuminated under a constraint that the extra power consumption for illuminating the highlighted area be no more than the product of a third quantity multiplied by a fourth quantity, where the third quantity may represent the difference between the full screen luminance limit (318) in type II highlight local dimming power profiles (or the full screen luminance value 314 in type I highlight local dimming power profiles) and the highlight peak luminance limit (316), and where the fourth quantity may represent the highlight area size limit (320).

In some embodiments, one or both of the highlight peak luminance limit (316) or the highlight area size limit (320) may be preconfigured, configured by a user, dynamically configured at run time, configured at the factory, configured as a design limit, etc., specifically for a target display device as described herein. Different target display devices may be configured with different sets of one or more power profiles, different highlight peak luminance limits, different highlight area size limits, etc.

In some embodiments, for a specific target display device, one or both of the highlight peak luminance limit (316) or the highlight area size limit (320) may be fixed. In a particular embodiment as illustrated in FIG. 4, both of the highlight peak luminance limit (316) or highlight area size limit (320) may be fixed. Accordingly, when the size of the highlighted areas in the image is above the highlight area size limit (320), the product of the first quantity multiplied by the second quantity is no more than a fixed number that equals to the product of the third quantity multiplied by the fourth quantity. In some embodiments, to satisfy this constraint, the group luminance value in FIG. 4 as computed (e.g., by a power management module 100, etc.) for the highlighted areas of the image may be limited to no more than luminance values as represented in FIG. 4, where the size of the highlighted areas is greater than the highlight area size limit (320). These luminance values form a section of a quadratic profile or a section of hyperbola with an asymptote approaching the full screen luminance limit in type II highlight local dimming power profiles (or the full screen luminance value 314 in type I highlight local dimming power profile) starting from the highlight peak area size limit (316).

In type I highlight local dimming power profile, the extra power consumption for illuminating the highlighted areas may be derived from an allocated power budget such as a preconfigured power budget, an extra power budget representing a percentile such as 10%, 12%, 15%, etc., over a full screen peak power limit.

In type II highlight local dimming power profile, the extra power consumption for illuminating the highlighted areas may be derived from adapting or clipping a full screen maximum luminance value (e.g., 314, etc.) to a value lower than a full screen peak luminance limit (e.g., 318, etc.).

For the purpose of illustration, it has been described that power management operations specific to a target display device may be performed with power profiles such as one or more of 302-1 through 302-5. It should be noted that power management operations specific to a target display device may be performed with other power profiles that can be similarly set up for the target display device.

For example, in some embodiments, power management parameters such as a total power budget per image, extra power consumption for highlighted areas, etc., may be estimated or represented (e.g., by areas, by pixels, by luminance values, by a mathematical relationship of the foregoing, etc.) for an image, for an image group, etc. Instead of setting to fixed numbers, one or both of a highlight area size limit and a highlight peak luminance limit can be adaptively set based on the power management parameters deduced from image data of the image, the image group, etc. Thus, even if the size of highlighted areas is greater than a fixed number such as 4%, 5%, etc., of the total area of an image rendering screen of a target display device, luminance values up to the highlight peak luminance limit (316) may be rendered by the target display device. Furthermore, even if a group luminance value of the highlight areas are represented in FIG. 4 is limited to a value lower than the highlight peak luminance limit (316), some individual spatial regions in the highlighted areas may still be illuminated to the highlight peak luminance limit (316) above the group luminance value, while some other individual spatial regions in the highlighted areas may be illuminated to a value lower than the highlight peak luminance limit (316) or the group luminance value.

In some embodiments, performing power management operations may involve mapping or adjusting code values decoded from an input media signal to different code values, different drive values, etc. The code values may be adjusted in a manner that maintains as high quality as close to input images coded in the input media signal. Code value adjustments for the purpose of power management may be performed dynamically from image to image, from image group to image group, etc., to ensure power consumption to stay under budget. These power management operations allow redistributing an overall power budget among different spatial regions of an image.

A target display device may assign a weight factor to a spatial region. A spatial region that has a relatively evenly distributed brightness level, a contiguous dark area, a contiguous bright area, etc., may be treated differently, given different weights, etc., in computing or estimating a group luminance value, in computing or estimating power consumption, etc., as compared with another spatial region that has a relatively unevenly distributed brightness level, a discontinuous brightness area, an area with relatively varied brightness levels, etc.

A target display profile may be set up with more than one power profiles. Even within the same power profile, depending on display applications, user input, system configuration, signaled metadata, etc., a target display device may set up different threshold numbers of pixels, different peak area size limits (e.g., 2% so that the highlight peak luminance limit may go up higher than 4%, etc.), different highlight peak luminance limits, etc.

A power management module as described herein may be in a feedback loop with a display driver of the target display device so that display device-specific parameters, scene-based parameters, power management parameters, display management parameters, etc., can be signaled between modules, devices, etc. For example, in an example scene in which a camera is panning from a relatively dark part (no visible Sun) of the scene to a relatively bright part (where Sun appears) of the scene, the target display device may perform relatively stable code value mappings so the artistic intent with the scene is preserved, even though the images related to the relatively dark part of the scene may contain no highlights whereas the images related to the relatively bright part of the scene may contain highlights.

For the purpose of illustration, a 4% of all pixels in an image has been sometimes used as a threshold number of pixels in highlighted areas of the image. The 4% highlighted areas correspond to 20% in each of two linear dimensions of a two dimensional display screen. It should be noted that this is for illustration only. Other percentiles can be used in various embodiments as threshold numbers of pixels or size for highlighted areas of images.

In some embodiments, to determine whether a spatial region is a part of a highlighted area of an image depends on whether the spatial region comprises a minimum number of pixels that comprise luminance values higher than a threshold luminance value. If the number of pixels is too small, the spatial region may be deemed as a non-highlighted area. This may be implemented by a power management module, a display management module, a target display device, etc., to prevent turning on high light intensity for a tiny feature, which may generate perceptible halo effects especially when the tiny feature is moving from image to image, etc.

9. Example Process Flow

FIG. 5 illustrates an example process flow. In some embodiments, one or more computing devices or components such as a power management module 100 of FIG. 1 and FIG. 2A through FIG. 2C, etc., may perform this process flow. In block 510, the power management module (100) receives, by a target display device, an input media signal including a portion of image data to be rendered with the target display device.

In block 520, the power management module (100) determines, based on the portion of image data, whether a first power profile among a plurality of power profiles for illuminating pixels is to be applied to rendering the portion of image data with the target display device.

In block 520, the power management module (100), in response to determining, based on the portion of image data, that the first power profile is not to be applied to rendering the portion of image data with the target display device, causes the target display device to render the portion of image data with the target display device by applying a second power profile among the plurality of power profiles. Here the first and second power profiles differ.

In an embodiment, the portion of image data comprises perceptually quantized reference code values.

In an embodiment, the portion of image data comprises non-perceptually quantized reference code values.

In an embodiment, the power management module (100) is further configured to generate, based on the portion of image data and in accordance with the second power profile, device-specific drive values to be used in rendering operations of the target display device.

In an embodiment, the first power profile represents one of constant light profiles, global dimming profiles, local dimming profiles, and highlight local dimming profiles.

In an embodiment, the second power profile represents one of constant light profiles, global dimming profiles, local dimming profiles, and highlight local dimming profiles.

In an embodiment, the second power profile represents a highlight local dimming profile; the power management module (100) is further configured to permit a number of pixels in an image to reach up to a first maximum luminance value without scaling down remaining pixels in the image to below a second maximum luminance value.

In an embodiment, the second power profile represents a highlight local dimming profile; the power management module (100) is further configured to permit a number of pixels in an image to reach up to a first maximum luminance value while scaling down remaining pixels in the image to below a second maximum luminance value.

In an embodiment, the power management module (100) is further configured to determine whether the portion of image data comprises an image with a minimum number of pixels in which luminance values of pixels in the block of pixels exceed a luminance threshold.

In an embodiment, the power management module (100) is further configured to perform: computing a percentile of pixels in a total number of pixels of an image, wherein pixels in the percentile of pixels are of luminance values exceeding a luminance threshold; determining whether the percentile of pixels exceeds a percentile threshold; etc.

In an embodiment, a method as described herein is performed by an upstream device that generates a target video signal based on the input media signal. In an embodiment, the upstream device is remote to the target display device. In an embodiment, the upstream device is local to the target display device.

In an embodiment, a method as described herein is performed by the target display device.

In some embodiments, process flows involving operations, methods, etc., as described herein can be performed through one or more computing devices or units.

In an embodiment, an apparatus comprises a processor and is configured to perform any of these operations, methods, process flows, etc.

In an embodiment, a non-transitory computer readable storage medium, storing software instructions, which when executed by one or more processors cause performance of any of these operations, methods, process flows, etc.

In an embodiment, a computing device comprising one or more processors and one or more storage media storing a set of instructions which, when executed by the one or more processors, cause performance of any of these operations, methods, process flows, etc. Note that, although separate embodiments are discussed herein, any combination of embodiments and/or partial embodiments discussed herein may be combined to form further embodiments.

10. Implementation Mechanisms—Hardware Overview

According to one embodiment, the techniques described herein are implemented by one or more special-purpose computing devices. The special-purpose computing devices may be hard-wired to perform the techniques, or may include digital electronic devices such as one or more application-specific integrated circuits (ASICs) or field programmable gate arrays (FPGAs) that are persistently programmed to perform the techniques, or may include one or more general purpose hardware processors programmed to perform the techniques pursuant to program instructions in firmware, memory, other storage, or a combination. Such special-purpose computing devices may also combine custom hard-wired logic, ASICs, or FPGAs with custom programming to accomplish the techniques. The special-purpose computing devices may be desktop computer systems, portable computer systems, handheld devices, networking devices or any other device that incorporates hard-wired and/or program logic to implement the techniques.

Figure 6:
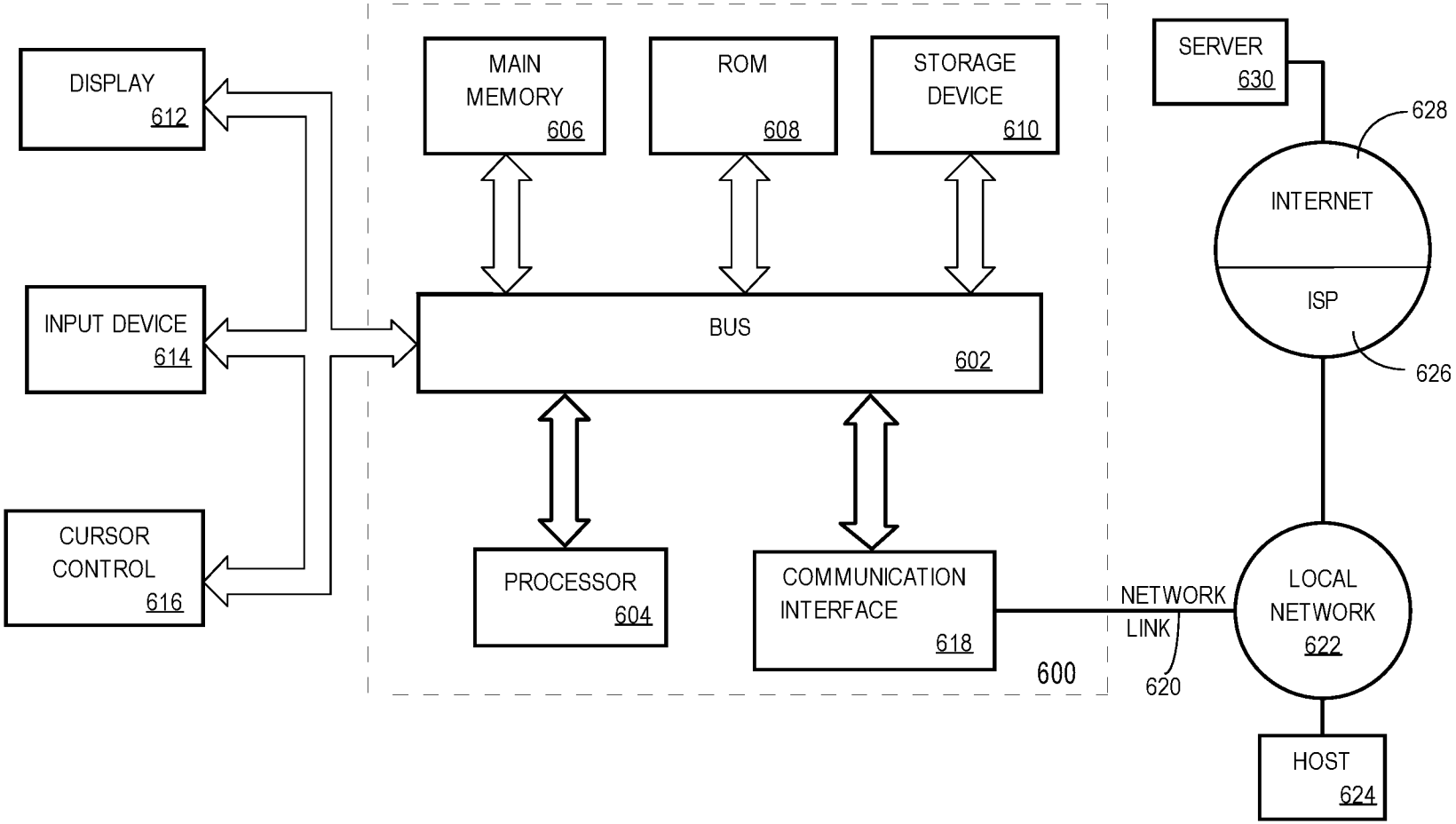
FIG. 6 illustrates an example hardware platform on which a computer or a computing device as described herein may be implemented, according a possible embodiment of the present invention.

For example, FIG. 6 is a block diagram that illustrates a computer system 600 upon which an embodiment of the invention may be implemented. Computer system 600 includes a bus 602 or other communication mechanism for communicating information, and a hardware processor 604 coupled with bus 602 for processing information. Hardware processor 604 may be, for example, a general purpose microprocessor.

Computer system 600 also includes a main memory 606, such as a random access memory (RAM) or other dynamic storage device, coupled to bus 602 for storing information and instructions to be executed by processor 604. Main memory 606 also may be used for storing temporary variables or other intermediate information during execution of instructions to be executed by processor 604. Such instructions, when stored in non-transitory storage media accessible to processor 604, render computer system 600 into a special-purpose machine that is customized to perform the operations specified in the instructions.

Computer system 600 further includes a read only memory (ROM) 608 or other static storage device coupled to bus 602 for storing static information and instructions for processor 604. A storage device 610, such as a magnetic disk or optical disk, is provided and coupled to bus 602 for storing information and instructions.

Computer system 600 may be coupled via bus 602 to a display 612, such as a liquid crystal display, for displaying information to a computer user. An input device 614, including alphanumeric and other keys, is coupled to bus 602 for communicating information and command selections to processor 604. Another type of user input device is cursor control 616, such as a mouse, a trackball, or cursor direction keys for communicating direction information and command selections to processor 604 and for controlling cursor movement on display 612. This input device typically has two degrees of freedom in two axes, a first axis (e.g., x) and a second axis (e.g., y), that allows the device to specify positions in a plane.

Computer system 600 may implement the techniques described herein using customized hard-wired logic, one or more ASICs or FPGAs, firmware and/or program logic which in combination with the computer system causes or programs computer system 600 to be a special-purpose machine. According to one embodiment, the techniques as described herein are performed by computer system 600 in response to processor 604 executing one or more sequences of one or more instructions contained in main memory 606. Such instructions may be read into main memory 606 from another storage medium, such as storage device 610. Execution of the sequences of instructions contained in main memory 606 causes processor 604 to perform the process steps described herein. In alternative embodiments, hard-wired circuitry may be used in place of or in combination with software instructions.

The term "storage media" as used herein refers to any non-transitory media that store data and/or instructions that cause a machine to operation in a specific fashion. Such storage media may comprise non-volatile media and/or volatile media. Non-volatile media includes, for example, optical or magnetic disks, such as storage device 610. Volatile media includes dynamic memory, such as main memory 606. Common forms of storage media include, for example, a floppy disk, a flexible disk, hard disk, solid state drive, magnetic tape, or any other magnetic data storage medium, a CD-ROM, any other optical data storage medium, any physical medium with patterns of holes, a RAM, a PROM, and EPROM, a FLASH-EPROM, NVRAM, any other memory chip or cartridge.

Storage media is distinct from but may be used in conjunction with transmission media. Transmission media participates in transferring information between storage media. For example, transmission media includes coaxial cables, copper wire and fiber optics, including the wires that comprise bus 602. Transmission media can also take the form of acoustic or light waves, such as those generated during radio-wave and infra-red data communications.

Various forms of media may be involved in carrying one or more sequences of one or more instructions to processor 604 for execution. For example, the instructions may initially be carried on a magnetic disk or solid state drive of a remote computer. The remote computer can load the instructions into its dynamic memory and send the instructions over a telephone line using a modem. A modem local to computer system 600 can receive the data on the telephone line and use an infra-red transmitter to convert the data to an infra-red signal. An infra-red detector can receive the data carried in the infra-red signal and appropriate circuitry can place the data on bus 602. Bus 602 carries the data to main memory 606, from which processor 604 retrieves and executes the instructions. The instructions received by main memory 606 may optionally be stored on storage device 610 either before or after execution by processor 604.

Computer system 600 also includes a communication interface 618 coupled to bus 602. Communication interface 618 provides a two-way data communication coupling to a network link 620 that is connected to a local network 622. For example, communication interface 618 may be an integrated services digital network (ISDN) card, cable modem, satellite modem, or a modem to provide a data communication connection to a corresponding type of telephone line. As another example, communication interface 618 may be a local area network (LAN) card to provide a data communication connection to a compatible LAN. Wireless links may also be implemented. In any such implementation, communication interface 618 sends and receives electrical, electromagnetic or optical signals that carry digital data streams representing various types of information.

Network link 620 typically provides data communication through one or more networks to other data devices. For example, network link 620 may provide a connection through local network 622 to a host computer 624 or to data equipment operated by an Internet Service Provider (ISP) 626. ISP 626 in turn provides data communication services through the world wide packet data communication network now commonly referred to as the "Internet" 628. Local network 622 and Internet 628 both use electrical, electromagnetic or optical signals that carry digital data streams. The signals through the various networks and the signals on network link 620 and through communication interface 618, which carry the digital data to and from computer system 600, are example forms of transmission media.

Computer system 600 can send messages and receive data, including program code, through the network(s), network link 620 and communication interface 618. In the Internet example, a server 630 might transmit a requested code for an application program through Internet 628, ISP 626, local network 622 and communication interface 618.

The received code may be executed by processor 604 as it is received, and/or stored in storage device 610, or other non-volatile storage for later execution.

11. Equivalents, Extensions, Alternatives and Miscellaneous

In the foregoing specification, embodiments of the invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. A method comprising:

receiving, by a target display device, an input media signal including a portion of image data to be rendered with the target display device;

determining, based on luminance values as determined from the portion of image data, whether a first power profile among a plurality of power profiles for illuminating pixels is to be applied to rendering the portion of image data with the target display device; and in response to determining, based on the luminance values as determined from the portion of image data, that the first power profile is not to be applied to rendering the portion of image data with the target display device, performing:

determining, based on the luminance values as determined from the portion of image data, a set of highlight spatial regions in one or more images represented in the portion of image data;

determining, based on the luminance values as determined from the portion of image data, a highlight peak luminance value for the set of highlight spatial regions;

rendering the portion of image data with the target display device by applying a second power profile among the plurality of power profiles, wherein the first and second power profiles differ, wherein the set of highlight spatial regions is illuminated up to a highlight peak luminance limit, wherein non-highlight spatial regions in the one or more images are illuminated up to a full screen maximum luminance value that is lower than the highlight peak luminance limit, wherein the first power profile represents a constant light profile, and the second power profile represents one of global dimming profiles, local dimming profiles, and highlight local dimming profiles.

2. The method of claim 1, wherein the portion of image data comprises perceptually quantized reference code values.

3. The method of claim 1, wherein the portion of image data comprises non-perceptually quantized reference code values.

4. The method of claim 1, wherein applying a second power profile to rendering the portion of image data with the target display device comprises generating, based on the portion of image data and in accordance with the second power profile, device-specific drive values to be used in rendering operations of the target display device.

5. The method of claim 1, wherein the second power profile represents a highlight local dimming profile; wherein applying a second power profile to rendering the portion of image data with the target display device comprises permitting a number of pixels in an image to reach up to a first maximum luminance value without scaling down remaining pixels in the image to below a second maximum luminance value.

6. The method of claim 1, wherein the second power profile represents a highlight local dimming profile; wherein applying a second power profile to rendering the portion of image data with the target display device comprises permitting a number of pixels in an image to reach up to a first maximum luminance value while scaling down remaining pixels in the image to below a second maximum luminance value.

7. The method of claim 1, wherein determining, based on the portion of image data, whether a first power profile is to be applied to rendering the portion of image data with the target display device comprises determining whether the portion of image data comprises an image with a minimum number of pixels in which luminance values of pixels in the block of pixels exceed a luminance threshold.

8. The method of claim 1, wherein determining, based on the portion of image data, whether a first power profile is to be applied to rendering the portion of image data with the target display device comprises:

computing a percentile of pixels in a total number of pixels of an image, wherein pixels in the percentile of pixels are of luminance values exceeding a luminance threshold;

determining whether the percentile of pixels exceeds a percentile threshold.

9. The method of claim 1, wherein the method is performed by an upstream device that generates a target video signal based on the input media signal.

10. The method of claim 9, wherein the upstream device is remote to the target display device.

11. The method of claim 9, wherein the upstream device is local to the target display device.

12. The method of claim 1, wherein the method is performed by the target display device.

13. An apparatus comprising a processor and configured to perform the method recited in claim 1.

14. A non-transitory computer readable storage medium, comprising software instructions, which when executed by one or more processors cause performance of the method recited in claim 1.

15. A computing device comprising one or more processors and one or more storage media storing a set of instructions which, when executed by the one or more processors, cause performance of the method recited in claim 1.

* * * * *